US005085529A

United States Patent [19]

McGourty et al.

[11] Patent Number: 5,085,529

[45] Date of Patent: Feb. 4, 1992

[54] THERMAL PRINTING SYSTEM WITH ENCODED SHEET SET

[75] Inventors: Thomas K. McGourty; Lawrence F. McGourty, both of Paso Robles, Calif.

[73] Assignee: Insignia Systems, Inc., Plymouth, Minn.

[21] Appl. No.: 527,037

[22] Filed: May 22, 1990

Related U.S. Application Data

[63] Continuation-in-part of Ser. No. 258,375, Oct. 17, 1988, abandoned.

[51] Int. Cl.[5] ..... B41J 2/355

[52] U.S. Cl. ..... 400/120; 400/76; 400/708

[58] Field of Search ..... 400/76, 120, 208, 207 E, 400/282, 583.3, 613, 624, 703, 705, 706, 708, 709, 711; 428/913; 346/76 PH; 355/40, 308, 311, 321, 323, 316, 317

[56] References Cited

U.S. PATENT DOCUMENTS

| | | | |
|---|---|---|---|
| 1,997,737 | 4/1935 | Mabon | 400/613.2 |
| 4,083,444 | 4/1978 | Salto | 400/208 |
| 4,257,172 | 7/1985 | Nagashima et al. | 400/120 |
| 4,468,139 | 8/1984 | Hattori | 400/120 |
| 4,494,862 | 1/1985 | Tanaka | 355/40 |
| 4,496,955 | 1/1985 | Maeyama et al. | 346/76 PH |
| 4,511,903 | 4/1985 | Miyazaki et al. | 400/120 |
| 4,659,213 | 4/1987 | Matsumoto | 355/40 |
| 4,660,053 | 4/1987 | Tsutsumi et al. | 346/76 PH |
| 4,673,304 | 6/1987 | Liu et al. | 400/208 |
| 4,700,791 | 10/1987 | Iwasaki et al. | 400/613 |
| 4,815,871 | 3/1989 | McGourty et al. | 400/120 |
| 4,977,419 | 12/1990 | Wash et al. | 355/40 |

FOREIGN PATENT DOCUMENTS

| | | | |
|---|---|---|---|
| 1455915 | 9/1974 | European Pat. Off. | 400/208 |
| 56-13193 | 2/1981 | Japan | 400/196 |
| 71181 | 6/1981 | Japan | 400/76 |
| 57-74181 | 5/1982 | Japan | 400/249 |
| 162092 | 10/1982 | Japan | 400/708 |
| 58-63494 | 4/1983 | Japan | 400/196 |
| 59-93376 | 5/1984 | Japan | 400/249 |
| 40881 | 1/1985 | Japan | 400/708 |
| 30369 | 2/1985 | Japan | 400/120 |
| 49978 | 3/1985 | Japan | 400/624 |
| 73888 | 4/1985 | Japan | 400/583.3 |
| 107376 | 6/1985 | Japan | 400/583.3 |
| 60-125685 | 7/1985 | Japan . | |
| 147364 | 8/1985 | Japan | 400/624 |
| 180892 | 9/1985 | Japan | 400/120 |
| 3772 | 1/1986 | Japan | 400/120 |
| 66668 | 4/1986 | Japan | 400/624 |
| 61-68275 | 4/1986 | Japan . | |
| 61-68276 | 4/1986 | Japan . | |
| 162375 | 7/1986 | Japan | 400/76 |

(List continued on next page.)

OTHER PUBLICATIONS

IBM Technical Disclosure Bulletin, vol. 19, No. 4, "Ribbon Drive", D. P. Darwin, pp. 1407–1408.

IBM Technical Disclosure Bulletin, vol. 25, No. 4, "Low Case Cartridge Code Detector", J. A. Craft, pp. 1980–1981.

Roger T. Stevens, "Graphics Programming In C", 1988, pp. 201–205.

Donald Hearn, "Computer Graphics", 1985, pp. 106–109.

*Primary Examiner*—David A. Wiecking

*Attorney, Agent, or Firm*—Merchant, Gould, Smith, Edell, Welter & Schmidt

[57] ABSTRACT

Different print sheet sets are disclosed to receive printing by a thermal printer. A thermal image transfer sheet is removably attached to a print sheet having a score line across the same to form a zone for coded indicia and a zone to receive printing. Indicia are provided in the indicia zone to represent certain conditions, such as the optimum thermal printing energy to be applied to pixels forming a printing head, and such indicia are sensed by a sensing device to program various aspects of printing, such as the printing format. The print sheet may be divided, as by scoring, into different print fields so that it may be readily separated into separate display signs.

26 Claims, 18 Drawing Sheets

FOREIGN PATENT DOCUMENTS

| | | | |
|---|---|---|---|
| 61-235172 | 10/1986 | Japan . | |
| 255875 | 11/1986 | Japan | 400/120 |
| 85234 | 4/1987 | Japan | 355/40 |
| 95273 | 5/1987 | Japan | 400/120 |
| 149463 | 7/1987 | Japan | 400/120 |
| 227777 | 10/1987 | Japan | 400/624 |
| 37949 | 2/1988 | Japan | 400/624 |
| 37964 | 2/1988 | Japan | 400/120 |
| 107573 | 5/1988 | Japan | 400/583.3 |
| 125363 | 5/1988 | Japan | 400/624 |
| 145056 | 6/1988 | Japan | 400/120 |

FIG. 1
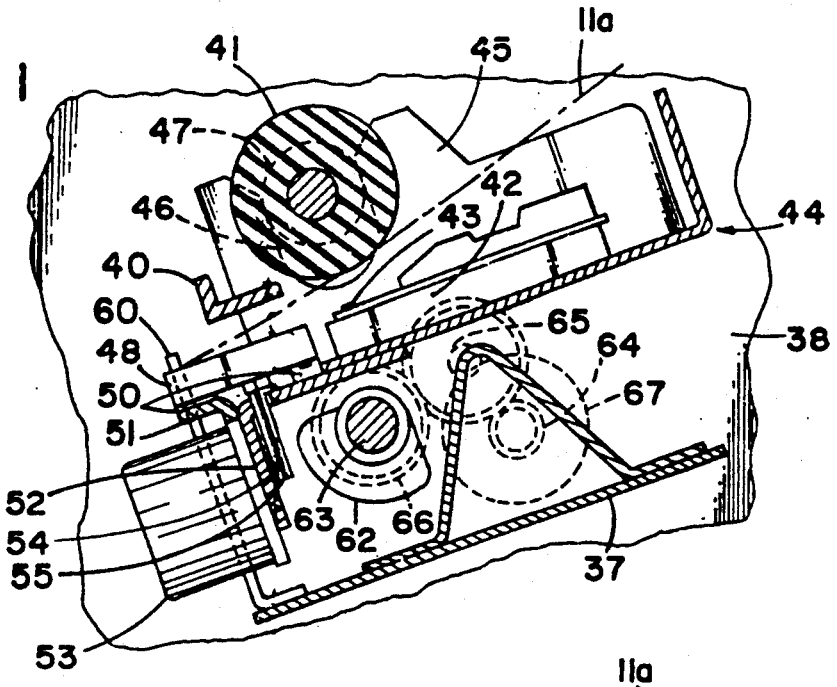
FIG. 2
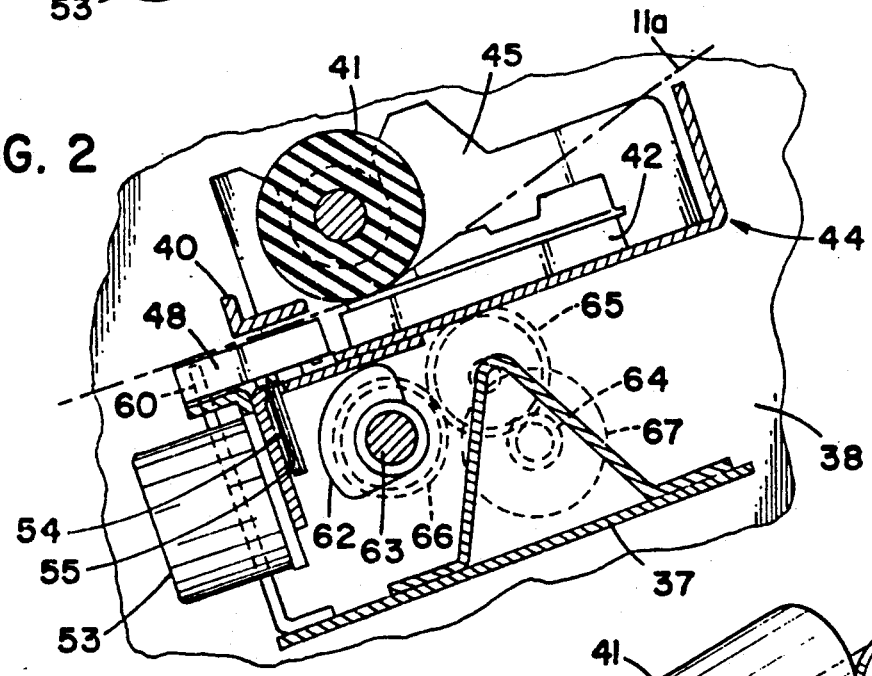
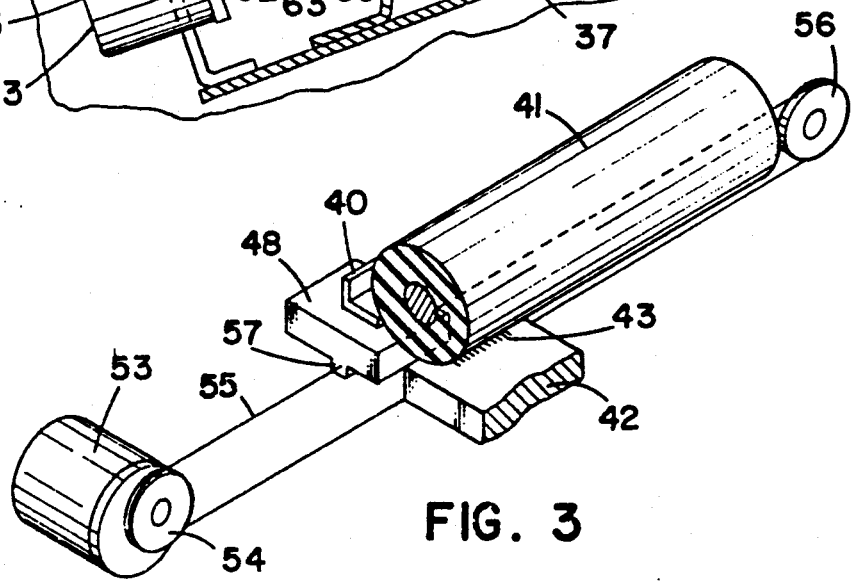
FIG. 3

THERMAL PRINTING SYSTEM WITH ENCODED SHEET SET

BACKGROUND OF THE INVENTION

1. Cross-Reference To Related Applications

This application is a continuation-in-part of patent application Ser. No. 258,375, filed Oct. 17, 1988, by Thomas K. McGourty et al., entitled "SIGN PRINTING SYSTEM", now abandoned, which application is incorporated herein by reference.

2. Field of the Invention

This invention relates to the art of sign printing and has particular reference to the printing of display signs such as are used in advertisements, etc.

3. Description of Related Art

Businesses such as restaurants, department stores, food stores, etc. often have the occasion to display signs showing new items, changing sales prices, festive events, warnings, and similar information. Such signs may be of different sizes depending on the amount of information to be presented, the size and location of the display area, and thus the size of the printed data must be varied to fit within the available sign area. Heretofore, such signs were generally either painted or printed by hand in which case the appearance or eye appeal depended on the skill of the painter or they were prepared by printing press facilities in which case the preparation of the printing plates was slow, expensive and often not warranted when only one or a few signs were required.

SUMMARY OF THE INVENTION

A principal object of the present invention is to automatically format and print signs.

Another object is to provide a printing sheet set for a thermal printing system in which the set contains coded instructions for automatically programming a thermal printer to print signs and the like.

Another object is to provide a sign printing system utilizing prepared print sheet sets having coded instructions for automatically programming a thermal printer according to predetermined conditions.

Another object is to provide a sign printing system using a print sheet set having coded instructions for programming a thermal printer in accordance with the size and other characteristics of the print sheet.

Another object is to provide a thermal printing system of the above type utilizing print sheet sets which include coded instructions for programming the thermal energy setting of the printer to provide optimum printing quality.

Another object is to provide a thermal printing system of the above type utilizing print sheet sets which include coded instructions for programming the color zone in which printing is to take place.

Another object is to provide a thermal printing system which obviates the need for an image transfer ribbon and ribbon feed mechanism.

According to the invention, a print sheet set is provided for a thermal printer comprising a print sheet, a pigment transfer overlay sheet thereon and coded data or indicia on the set for automatically programming various functions of the printer in accordance with different characteristics of the print sheet, such as the size of the sheet, the material of the sheet, the optimum thermal heat energy for best printing and the printing color.

The thermal printer is controlled by an electronic microprocessor having, as an input, a keyboard for setting up data to be printed and a reader for sensing the code indicia and for causing the microprocessor to program such functions as the optimum amount of thermal energy, the field of printing in accordance with the size of the print sheet or size of the field to be printed within the sheet, and means for determining the appropriate size of the data to be printed commensurate with the size of the print field. Thus, the system can be programmed by relatively unskilled operators and will result in a minimum wastage of time and supplies in arriving at an appropriate format and size of printing for a particular size print field.

BRIEF DESCRIPTION OF THE DRAWINGS

The manner in which the above and other objects of the invention are accomplished will be readily understood on reference to the following specification when read in conjunction with the accompanying drawings, wherein:

FIG. 1 is a transverse sectional view through a thermal printer for carrying out the present invention and showing the same in an open condition preparatory to receiving a print sheet set;

FIG. 2 is a sectional view similar to FIG. 1 but showing the printer in printing condition;

FIG. 3 is a perspective view, with parts broken away, showing the device for traversing the code reader over the coded indicia;

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

The printing system of the present invention utilizes the known process of thermal image printing in which a transfer ribbon having a wax pigment thereon is passed, in contact with a tape to be printed, under a thermal printing head having a row of heat generating elements forming pixels. By using electronic processing techniques, the pixels are selectively heated to melt underlying minute areas of the transfer pigment and to transfer the wax particles on a suitable tape. Such a process is disclosed in U.S. Pat. No. 4,815,871, issued Mar. 28, 1989, to Thomas K. McGourty et al, incorporated herein by reference, and the co-pending patent application of Thomas K. McGourty et al, Ser. No. 584,436 filed on Sept. 13, 1990, incorporated herein by reference, which is a file wrapper continuation of application Ser. No. 934,650 filed on Nov. 25, 1986, now abandoned. However, in such known processes, further operations are necessary to utilize the printed images on the tape to form an appropriate sign or the like.

Describing first certain typical print sheet sets which embody different aspects of the present invention, reference is had to FIGS. 4 to 12. Such sets may be provided in different sizes and shapes and the print sheets of certain of the sets may be divided by scoring or the like to form separable print fields in which different or similar sign information may be printed.

Figure 4:
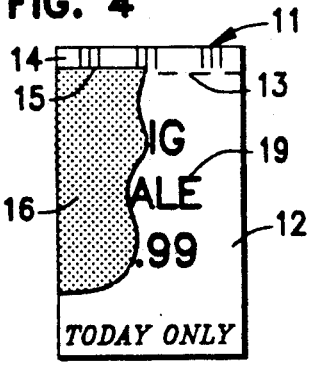
FIG. 4 is a face view of a sample print sheet set, with a thermal transfer sheet partly broken away, embodying one form of the present invention, and wherein a single print field is printed on the print sheet.

FIG. 4 shows a typical print sheet set, generally indicated at 11, comprising an underlying print sheet 12 which may be either relatively limp or relatively stiff and of any suitable material such as paper, plastic or metal. The sheet 12 is scored or other wise weakened at 13 across the upper portion thereof to form a coding zone 14 on which a set of coded indicia or identifiers 15 are preprinted.

Such coded indicia 15 may, for example, be formed according to the well known "bar code" system arranged to present machine readable data such as the type of material forming the print sheet, the size and format of the print sheet, the optimum thermal head setting for the printing pixels, and color format information.

Other forms of coded data or indicia may be used in lieu of the imprinted bar code, such as punched or perforated coding, magnetic ink coding or the like.

A thin thermal transfer sheet 16 having a coating of a wax pigment thereon covers the sheet 12 and is preferably permanently attached to the upper zone 14 of the print sheet 12 by a suitable adhesive. The remainder of the transfer sheet 16 may, if desired, be weakly secured to the surface of the sheet 12 by a suitable adhesive so that it may be subsequently peeled away when the zone 14 of sheet 12 is later separated after printing. Alternatively, the transfer sheet may be weakly secured to the print sheet by an electrostatic charge.

FIG. 4 illustrates the print sheet set after printing in which a message 19 is formed on the print sheet 12.

Figure 5:
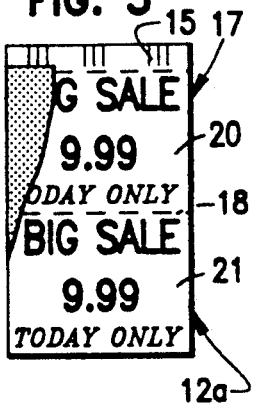
FIG. 5 is a face view of another sample print sheet set in which two print fields are printed on the same print sheet.

FIG. 5 illustrates another typical print sheet set 17 which is similar to that shown in FIG. 4 except that the print sheet 12*a* is scored along a tear line 18 to divide the sheet into two print fields 20 and 21 which may be readily separated to form two separate signs. Since the same message is printed in both fields as occurs in FIG. 4, it is obvious that the size of the letters must be reduced.

Scoring may be accomplished in different manners, such as by forming a line of perforations (not shown) to enable the print sheet to be readily separated into the separate print fields after printing.

Figure 6:
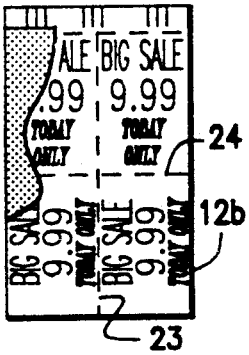
FIGS. 6 and 7 are face views of sample print sheet sets in which different numbers of print fields are printed on the same print sheet.

FIG. 6 illustrates another typical print sheet set in which the print sheet 12*b* is scored at 23 and 24 to form four separate print fields in which four duplicate messages may be imprinted. Obviously, the size of the letters forming the messages must be reduced to fit within the areas of the print fields. The scoring enables the sheet to be readily separated into four different signs or the like.

Figure 7:
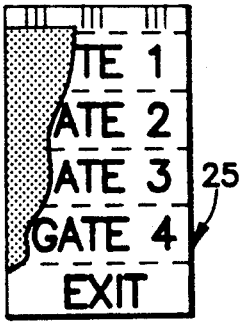
Figure 8:
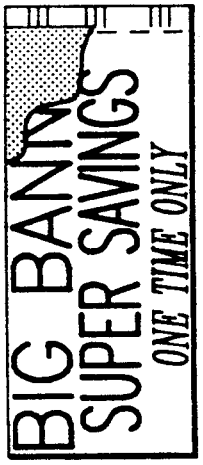
FIG. 8 is a face view of a sample elongated print sheet set on which an elongated or banner type field is printed.
Figure 9:
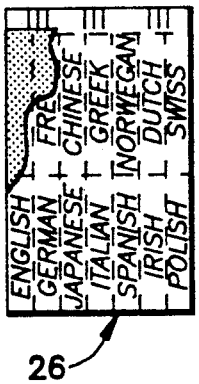
FIG. 9 is a face view of a sample print sheet set incorporating a multiplicity of print fields on the same print sheet.

FIGS. 7 and 9 show other typical print sheet sets 25 and 26, respectively, having different scorings to enable printing of large numbers of messages and in which the messages may differ from each other or may be the same. FIG. 8 illustrates another typical print sheet set for printing an elongated or banner message.

Figure 10:
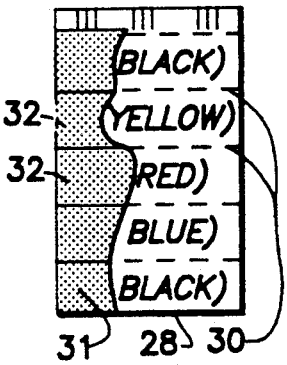
FIG. 10 is a face view of a sample print sheet set in which multiple fields are printed in different colors on the same print sheet.

FIG. 10 shows another typical print sheet set including a print sheet 28 scored at 30 to form five different print fields. An overlying thermal transfer sheet 31 is divided into five zones 32 having differently colored wax pigment coatings overlying respective fields of the print sheet 28. Thus, differently colored messages may be printed in the different print fields on the sheet 28.

Alternatively, in lieu of scoring, the sheet may be divided by forming a visible line or lines along which the sheet may be later cut to divide the same into separate signs.

Figure 11:
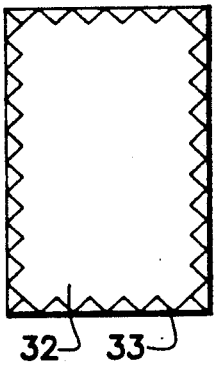
FIG. 11 is a face view of a sample print sheet on which a preprinted decorative design may be provided.
Figure 12:
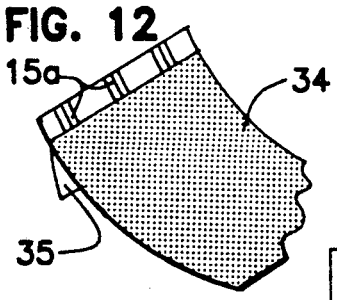
FIG. 12 is a perspective view of a thermal transfer sheet combined with a backing sheet with coded indicia there on and intended for use with a print sheet such as that shown in FIG. 11.

FIG. 11 shows a typical print sheet 32 on which a decorative design 33 or the like may be preprinted. In this case, a transfer sheet 34 (FIG. 12) is provided separately and is attached at its upper end to a short backing sheet 35 having coded indicia 15*a* imprinted or otherwise formed along its upper edge. During the printing operation which will be described presently, a composite print sheet set is formed by inserting the upper end of sheet 32 of FIG. 11 between the transfer sheet 34 and the underlying backing sheet 35.

Describing now the printer for printing the aforementioned print sheets, reference is had to FIGS. 1 to 3 wherein the printer comprises a stationary frame including a cross brace 37 secured to a pair of side frame plates, one of which is shown at 38. A cross bar 40 also extends between the frame plates 38. A platen 41 is rotatably supported by bearing mounted on the frame plates, i.e., 38.

Figure 13:
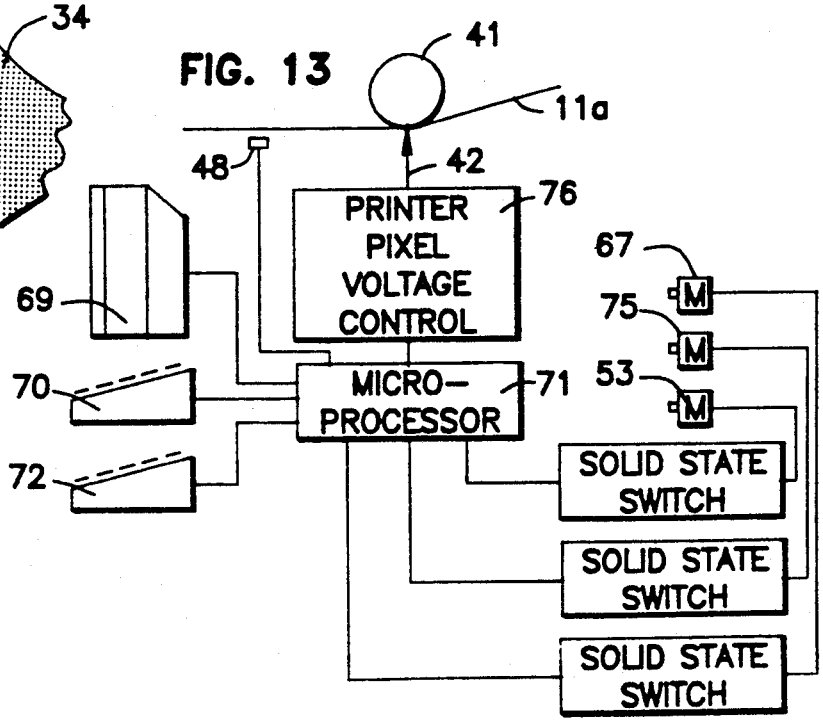
FIG. 13 is a schematic electrical diagram of circuitry for controlling the printer.

A thermal print head 42 controlled by a voltage control circuit 76 (FIG. 13) and carrying a row of pixels 43 (see also FIG. 3) is mounted on a carriage 44 for vertical movement toward and away from the platen 41. The carriage has side plates, one of which is shown at 45. Each side plate has a guide slot 46 slidably embracing a cylindrical bearing 47 on the platen, and such guide slots, along with other guide means, not shown, guide the carriage vertically.

A code reader head 48 is carried by the carriage 44 for reading the coded indicia on a print sheet set. The head 48 per se forms no part of the present invention and is of known construction and is used in reading conventional bar codes or optical or other codes. The head is mounted for movement across the carriage 44 on suitable slide bearings 50 formed on rails 51 and 52 forming part of the carriage 44. For the purpose of moving the head in a scanning movement across an inserted print sheet set, indicated by dot-dash lines 11*a* in FIGS. 1 and 2, a reversible stepper motor 53 is provided (see also FIG. 3), the output of which drives a pulley 54 around which a cord 55 is reeved. Motor 53 is carried by the carriage rail 52 and the cord 55 is also reeved around a second pulley 56 also rotatably supported in a manner not shown by the rail 52. The ends of cord 55 are attached, as indicated at 57, to opposite ends of the read head 48.

The printer is normally in its open condition shown in FIG. 1 to receive a printer sheet set, i.e. 11*a*. In this condition, the print head 42 is located sufficiently below the platen 41 to allow a relatively stiff print sheet to be slid along suitable guides, not shown, into a fully inserted position where it is arrested in precise printing alignment by spaced upstanding stops 60 suitably attached to the printer frame brace 37.

Means are provided for raising the printer carriage 44 into a printing position shown in FIG. 2 to press the pixels 43 against the inserted print sheet set and to cause the code read head 48 to establish intimate reading contact with the code indicia against the cross bar 40. Also, as the print carriage 44 is raised, the leading edge of the print sheet set is clear to move freely above the stops 60 so that the platen 41 can be subsequently rotated to feed the print sheet set past the printing pixels 43.

For the purpose of raising and lowering the print carriage 44, cams, one of which is shown at 62, are carried by a cam shaft 63 and are engageable with the underside of the carriage rail 52. Shaft 63 is mounted in bearings in the frame plates 38 and is driven by a suitable motor 67 through a gear train 64, 65, and 66.

Describing now the operation of the printer, the message to be printed is set up on a data keyboard 70 (FIG. 13) and such data is entered into microprocessor 71 and preferably also displayed on a multi-line display panel or CRT screen 69. Or a message might be called up from stored messages in the microprocessor memory. A desired print sheet set, such as one of those depicted in FIGS. 4 to 12, is selected and inserted in the printer. A suitable key of, a function keyboard 72 is set, causing the motor 67 to raise the printer carriage into its printing position of FIG. 2. The motor 53 is then energized to cause the read head to scan the coded indicia, thus entering such data as the size and format of the inserted print sheet set into the microprocessor, causing the latter to process the coded data to program the final print formatting and printing process.

Thus, the coded data which is inputted into the microprocessor completes the programming of the system by providing means to automatically input printing variables for the particular sheet that is selected, as will be described presently.

Finally, a motor 75 is energized to rotate the platen 41 to feed the print sheet set past the row of print pixels 43.

Messages, phrases, formats, etc. to be used in printing can be stored within a memory unit of the microprocessor and recalled at a later date. In such case, the print field may have to be modified in size and form to be compatible or fit with and into a newly selected print set. Such modification will be accomplished automatically to effect proper enlargement or reduction of the print field to properly balance the format outline. It will also, for example, effect multiple duplicated printing in multiple fields as depicted in FIGS. 5 to 7 without the intervention of the operator. Further, the coded information will be effective when processed by the microprocessor to prevent printing of a selected print sheet set when such set is not suitable or compatible for printing a memory stored format. In such case, the microprocessor may be programmed to advise the operator of an appropriate print sheet set to use.

The preferred embodiment assumes no limitation on the printing mechanism, and uses the coded indica on a print sheet set to specify the printing process. The printing process is thus modified to fit the print sheet set.

For best print quality, the platen pressure, thermal heating rate and ability of the print head elements as well as thermal characteristic of both the thermal ribbon and receiver sheet must be considered.

For best print quality when using a thermal ribbon as an ink donor, the ink adhesion characteristics of a receiver sheet must be considered in the print heat calculation. The on time energization of a thermal print head only relates to melting the thermal wax of the print ribbon. The adhesion of the wax to the receiver sheet is related to the rate of ink flow and cooling of the wax onto the receiver sheet. Thus, the ink adhesion ability of the receiver sheet plays a significant role in achieving best print quality.

In general, smooth treated surfaces allow very quick ink transfer once the ink has been melted, because the ink is in good and uniform contact, the cooling and adhesion period is very quick. Because the printing elements or pixels of a typical thermal print head cannot be instantaneously cooled, for best print quality it is advantageous to minimize ink flow by moving the heated printing elements away from the print area as quickly as possible. Continued heating of the ink will cause excessive ink flow and print smearing. Hence, the total print cycle time should be shortened.

Porous or rough materials require a longer transfer time to allow the ink to flow and fill crevices and cracks in the surface. In this situation it is advantageous to allow the heated printing elements to pause over the print area to maximize ink flow to insure complete transfer. Hence, the total print cycle time should be lengthened.

Thus, the same thermal ink ribbon must be used differently to achieve best print results on different print receiver sheets.

In the case of direct thermal, where heat is directly used to develop the image, there is no associated ink flow. The energization and dwell times of the printing elements are set so that there is sufficient heat transferred to cause printing at the most optimum speed and power consumption for the thermal print head.

To provide the best print quality, the preferred embodiment controls both the print head energization time to melt the ink, as well as the total time that the heated printing elements dwell over the print area. This is done by specifying a total variable cycle time, and separately, the actual printing element energization time. These characteristics are determined for a specific combination of thermal ribbon and receiver sheet at the time the combination is made. Thus, any variation in the thermal characteristics of the thermal ribbon due to production variation or aging is compensated for.

The coded indicia comprises a bar code encoded onto the print sheet set which indicates to the printer the thermal scaling values and supply format values to be used in the printing process. All aspects of the printing process are thus automatically programmed without user intervention. This prevents an inappropriate printing mode being used, which could result in ruined supplies or damage to the printer.

The preferred embodiment has a number of benefits, which include: (1) considering the thermal ribbon (if used) and receiver sheet as a system, (2) placing the bar code on a removable portion of the print set, hence, no ribbon is required, (3) specifying the heating characteristics at the time of the manufacture of the print sheet set, and (4) specifying the heating factors as a scaling value to a nominal pulse time rather than a hard-coded value.

The preferred embodiment does not relate the printing to just the physical melting point of the thermal ribbon. The energization pulse width as well as the dwell time are specified in the bar code for optimum printing conditions for a particular thermal ribbon (if used) and receiver sheet combination. The bar code is specified at the time a print sheet set is created, hence any variance in the thermal properties of the material due to aging or manufacturing can be compensated for in the programming. Further, the bar code is appended to the print sheet set and read by the printer prior to printing to insure optimal printing conditions.

The bar code specifies how a particular combination of materials should be printed relative to a test standard. Compatible printers need only contain specific information on how to print the test standard.

By supplying a scaling value with a large dynamic range, rather than specific physical values, new supplies can be developed with much different physical printing properties and they can be used with existing printers with no modification to the printer.

A scheme which relies upon specific physical values, i.e., hard-coded values, is restricted to a limited number of supplies used with a specific printer. The preferred embodiment relies upon the scaling of the printing values to a known test standard which may be printed differently depending upon the printer used. The preferred embodiment is more flexible since it explicitly encodes the optimum printing conditions for a print sheet set, and is encoded to instruct the printer how to modify the printing method of the test standard set to effect best possible printing.

There may also be a variance in the heating speed and range of the thermal print head and platen combination on different printer types. Because the print sheet sets are used in different printers, hard-coded thermal heating characteristics cannot be specified for the printer. Instead, in the preferred embodiment, the bar code specifies a scaling factor for the total cycle time or dwell time as well as energization time.

In the preferred embodiment, each compatible printer has a nominal total print cycle time value and energization time value stored in ROM for a specific ambient temperature and line dot density time. This nominal value specifies the cycle and energization times that are required for the printer (thermal print head and platen combination) to achieve the best quality print on a standard test print sheet set at the ambient temperature and the line density. The ambient temperature is taken into consideration because it specifies the base temperature of the thermal print head. If the thermal print head is already warm, less energization time is required to achieve ink melting temperature. The line dot density is also considered because it specifies the total number of printing elements which will be simultaneously energized. If multiple printing elements are energized, there will be a contributory heating affect, again resulting in a lower energization to achieve ink melting temperature. The bar code specifics a thermal scaling factor for the total cycle time and energization time to modify the nominal print cycle values to achieve the best possible print quality on the particular print sheet set. These factors are binary floating point numbers between 0.0000000 and 1.1111111, giving an adjustment range of $\pm/-100\%$ variation.

Even though different printers may print the standard test sheet using very different energization and print cycle times, because of different print head and platen combinations, print sheet sets with thermal scaling values coded thereon will give best possible print results in any case.

In the preferred embodiment, the bar code is printed on an appended portion of the print sheet set at the time of conversion of the bulk supplies, not at the time of manufacture of the bulk thermal ribbon and receiver sheet material. Any deviation in the thermal print characteristics of the components due to manufacturing or aging conditions, can thus be compensated for at the time of conversion. Also, the scaling factors are set so that specific combinations of thermal ink ribbon (if used) and receiver sheet print optimally.

Finally, independent control of the total print cycle time and energization time, as well as the large dynamic adjustment range of the bar coded thermal scaling factors, insures that when new print sheet sets are developed, they can be bar coded and utilized on existing printers.

In addition to thermal scaling values, the bar code also contains supply format values. The supply format values define the size of the sheets, as well as the location and orientation of the sub-sheets and special color fields. The printing process is then adjusted to effect proper printing.

In some applications, it is desirable to have small printed images. However, it is physically undesirable to print a receiver sheet of a width more narrow than the actual thermal print head. If the receiver sheet does not cover all the printing elements of the thermal print head, and the platen makes direct contact with the printing elements, it can cause damage to the exposed printing elements. This means that the receiver sheet width should not be less than the width of the print head.

In other applications, the image may be printed in unusual orientations, for example, from top to bottom (banner printing) rather than left to right. In such cases, the critical parameter is the length of the receiver sheet, not the width. The physical detection of the length of a sheet before print operation would require either an impractical number of detectors, or a severe restriction in the allowable paper length. The bar code provides both size and format values, thus eliminating the need to physically sense the size and length of the receiving sheet.

The bar code allows the printer to properly print individual smaller images onto a master receiver sheet pre-scored into an arbitrary number of multiple smaller print sheets in any geometry and orientation. These sub-sheets remain attached left to right and top to bottom during the printing operation to protect the print head. Because there is no restriction on the length of the form, multiple appended sub-sheets or banners may be very long. Without the bar code to specify the exact format of the scoring on the receiver sheet, it would be virtually impossible to sense the width, length, orientation and location of the multiple attached sub-sheets on the master sheet and to automatically adjust the printing and printing process without operator intervention.

The preferred embodiment requires no physical marking of the sheet or sub-sheet. To the contrary, the bar code is meant to be removed after printing. The bar code specifies the location, orientation and number of sub-sheets on the master receiver sheet. This information is combined with the precision printing ability of the thermal print head to accurately print each sub-sheet or color field at its proper location on the receiver sheet.

The approach of the preferred embodiment has no restriction on the printing area (other than to safely cover the print head elements), so perforations can be arbitrarily located in any combination of sizes and orientations. In the preferred embodiment, there is no restriction on the orientation of the perforations to a specific printing area. The bar code specifies the exact location, number, size and orientations of the perforations to allow the printer to adjust the printing process for accurate printing between the perforations. It is sufficient for the operator to place an encoded print sheet set into the printer. The bar code supplies all the information required to scale the image and print the image so that it fits uniformly and aesthetically between the perforations.

In the case of attached multiple sub-sheets, with multiple color fields in an arbitrary layout and orientation on the master sheet, there is no physical property which can explicitly indicate the location of the sub-sheets. For this reason, the supply format values explicitly and automatically define the orientation and layout of the sub-sheets on the master sheet to allow for automatic adjustment of the printing process.

The preferred embodiment uses a portion of the bar code to specify that areas of the single sheet of thermal ribbon (or specially treated direct thermal print paper if no ribbon is used) are capable of printing in different colors. The printer adjusts text size and print location to fit within these specified colored areas. Multiple color print can thus be correctly located and printed in a single pass with uniform results.

Figure 14:
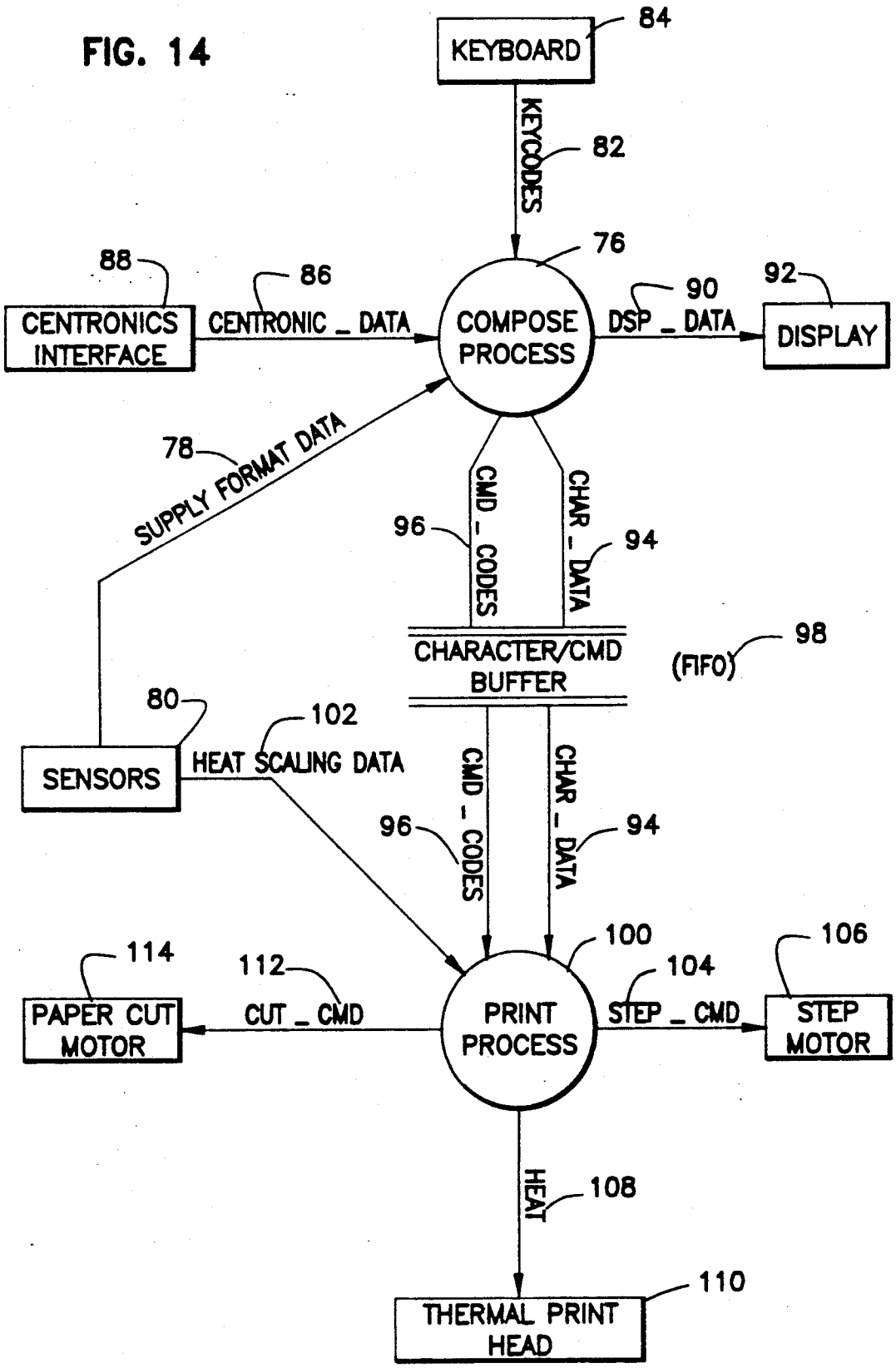
FIG. 14 is a dataflow diagram describing the operation of the preferred embodiment.

FIG. 14 is a dataflow diagram describing the operation of the preferred embodiment. The Compose Process 76 accepts supply format data 78 from the sensors 80, keycodes 82 from the keyboard 84, and information 86 from the Centronics® interface 88 to create an image for printing. The image may be previewed using display data 90 on an operator display 92. Character data 94 and command codes 96 comprising the image are transferred to a FIFO buffer 98. The character data 92 and command codes 96 are read from the FIFO buffer 98 by a Print Process 100. The Print Process 100 also accepts heat scaling data 102 from the sensors 80. The Print Process 100 generates commands 104 to the stepper motor 106 and sends heating pulses 108 to the thermal print head 110. In the preferred embodiment, perforations in the paper and precision plotting obviate the need for paper cutters, however, the Print Process 100 also could send commands 112 to a paper cut motor 114 to separate the different sub-sheets.

Figure 15A:
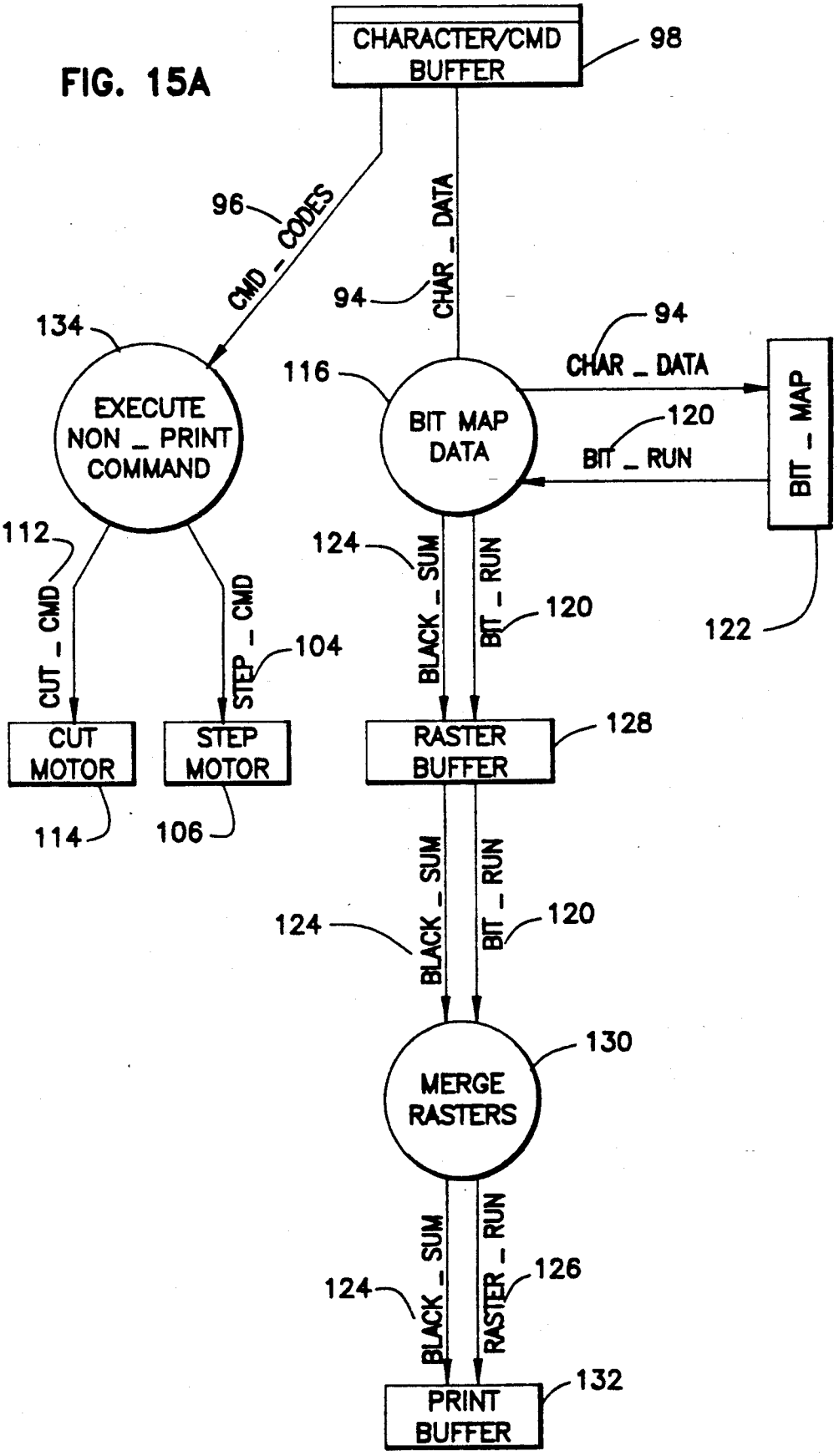
FIGS. 15*a* and 15*b* are dataflow diagrams further describing the Print Process 100 of FIG. 14.
Figure 15B:
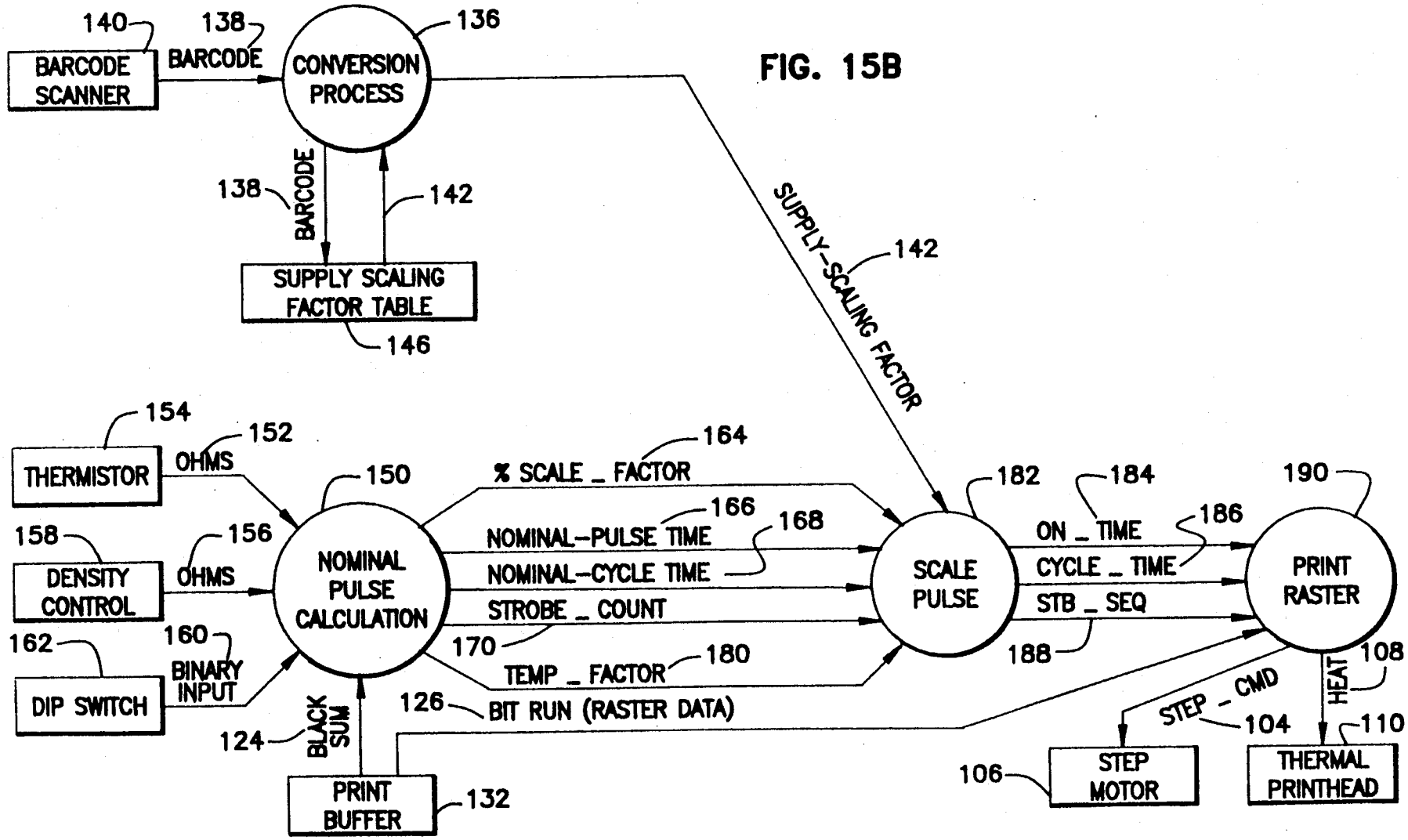

FIGS. 15*a* and 15*b* are dataflow diagrams further describing the Print Process 100 of FIG. 14. FIG. 15*a* specifically describes the method of formatting text and graphics. Commands 96 are read from the FIFO buffer 98 and executed by Task 134. Task 134 sends commands 112 to the cut motor 114 and commands 104 to the step motor 106. Character data 94 is read from the FIFO buffer 98 by Task 116. The character data 118 is translated into bit map data 120 by Task 122. Task 116 sends the bit map data 120 and a black dot sum 124 to a raster buffer 128. Task 130 reads the bit map data 120, and merges multiple images into raster data 126. The black dot sum 124 and raster data 126 are then stored in a print buffer 132.

FIG. 15*b* specifically describes the method of thermal heating of the thermal print head elements. In FIG. 15*b*, a number of sensors are used to control the thermal heating. The bar code scanner 140 reads the bar code 138. The Conversion Task 136 uses the bar code data 138 as an index into the Supply Scaling Factor Table 146 in order to retrieve the supply scaling factor 142. The supply scaling factor 142 is then sent to the Scale Pulse Task 182. The Nominal Pulse Calculation Task 150 senses ohmic data 152 and 156, and binary data 160 from a thermistor 154, density control 158, and dip switches 162, respectively. The Task 150 also reads the black dot sum 124 from print buffer 132. From these various inputs Task 150 generates the outputs percentage scale factor 164, nominal pulse time 166, nominal cycle time 168, strobe count 170, and temperature factor 180 for the Scale Pulse Task 182. The Scale Pulse Task 182 uses its various inputs to generate the outputs of on time 184, cycle time 186, and strobe sequence 188, which are input to the Print Raster Task 190. In addition to these inputs, the Print Raster Task 190 also accepts the raster data 126 from the print buffer 132. The Print Raster Task 190 generates the commands 104 for the step motor 106 and commands 108 which activate the thermal print head.

Figure 16:
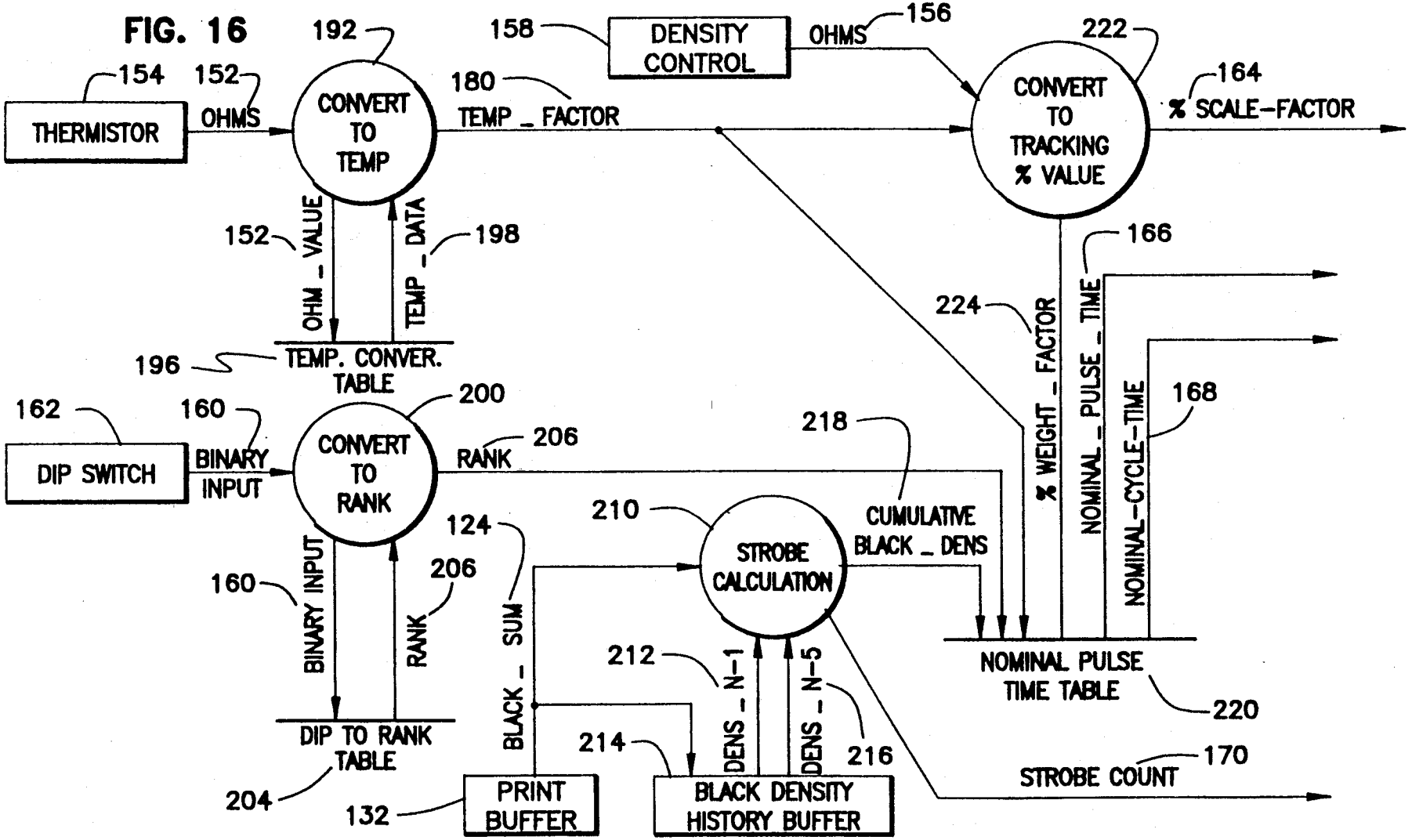
FIG. 16 further describes the Nominal Pulse Calculation Task 150 of FIG. 15*a;*

FIG. 16 further describes the Nominal Pulse Calculation Task 150 of FIG. 15*a*. Ohmic data 152 is input from thermistor 154 to Conversion Task 192. The ohmic value 152 is used to look up the temperature data value 198 from the Temperature Conversion Table 196. The Conversion Task 192 outputs a temperature factor 180. Conversion Task 200 accepts binary input 160 from the dip switches 162. The Task 200 uses the binary input 202 to look up rank data 206 from the Dip-To-Rank Table 204. The Conversion Task 200 outputs rank data 206. Strobe Calculation Task 210 accepts the black dot sum 124 from the print buffer 132. The black dot sum 124 is used to look up prior black dot densities 212 and 216 from the Black Density History Buffer 214. The Strobe Calculation Task 210 outputs a strobe count 170 and a cumulative black density 218. The temperature factor 180 rank 208 and cumulative black density 218 are used by Conversion Task 222 to look up the percentage weight factor 224 from the Nominal Pulse Time Table 220. The Conversion Task 222 also accepts ohmic data 156 from the density control 158 to calculate a percentage scale factor 164. Also output from the Nominal Pulse Time Table 220 are the nominal pulse time 166 and nominal cycle time 168.

Figure 17:
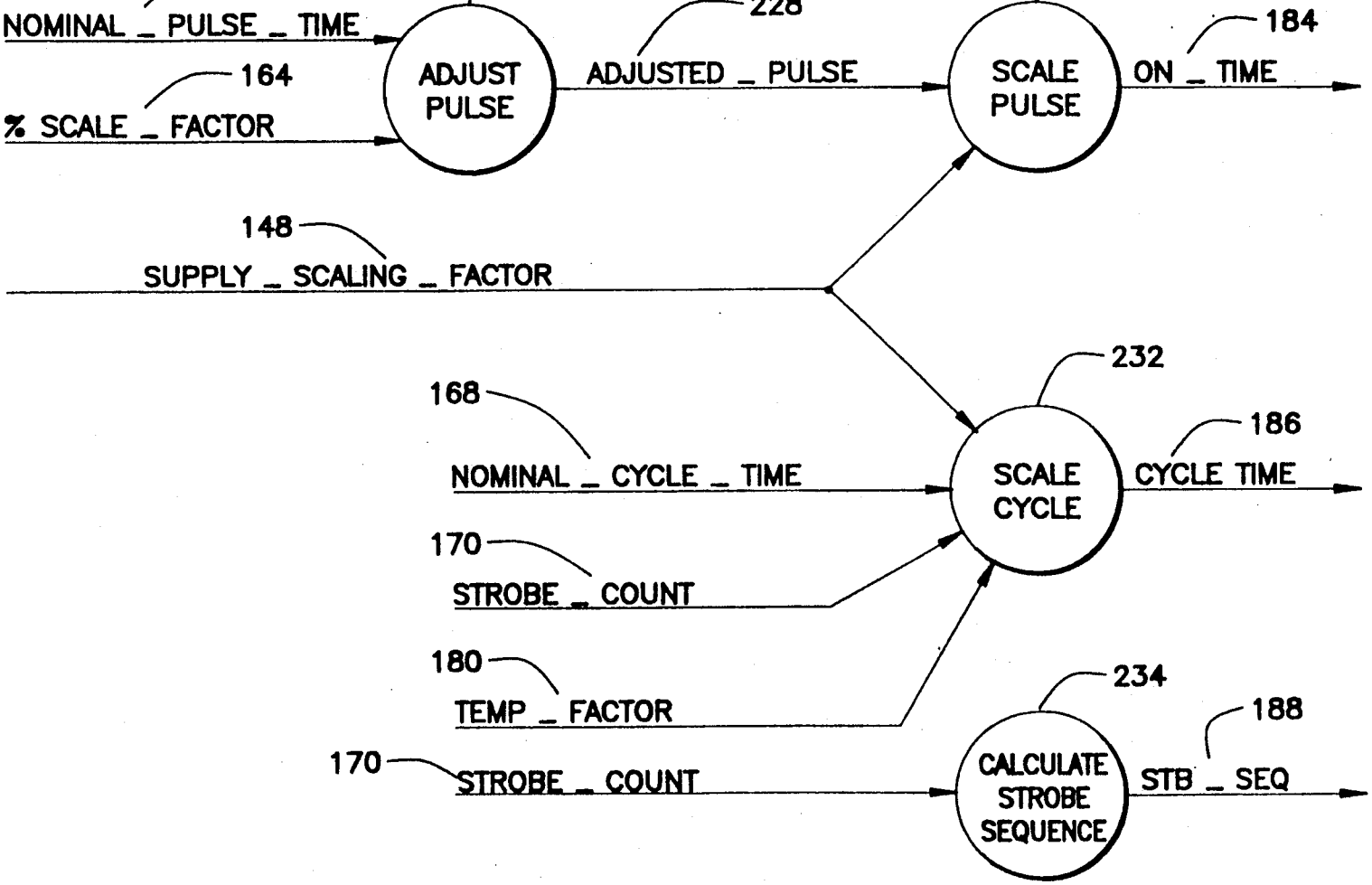
FIG. 17 describes the scaling method performed by Scale Pulse Task 182 in FIG. 15*b;*

FIG. 17 describes the scaling method performed by Scale Pulse Task 182 in FIG. 15*b*. The Adjust Pulse Task 226 accepts as input the nominal pulse time 166 and percentage scale factor 164 and as output calculates the adjusted pulse 228. The Scale Pulse Task 230 accepts the adjusted pulse 228 as input along with the supply scaling factor 148 to create the on time value 184. The Scale Cycle Task 232 accepts as input the supply scaling factor 148, nominal cycle time 168, strobe count 170, and temperature factor 180 to calculate the cycle time 186. The Calculate Strobe Sequence Task 234 accepts the strobe count 170 and calculates the strobe sequence 188.

Figure 18:
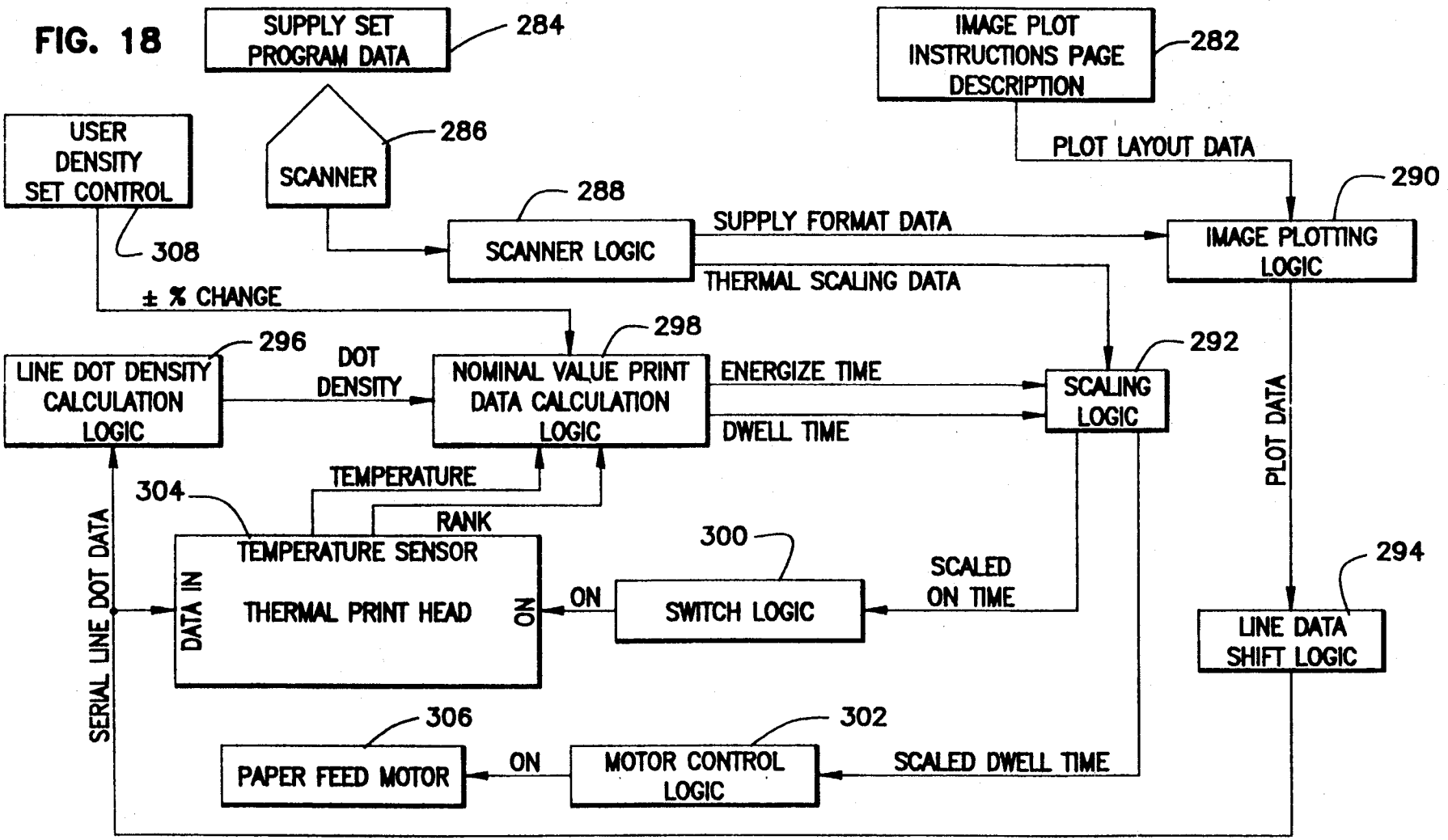
FIG. 18 is a block diagram describing the components of the printer control system which achieve the operations described in the dataflow diagrams of FIGS. 14–17.

FIG. 18 is a block diagram describing the components of the printer control system which achieve the operations described in the dataflow diagrams of FIGS. 14–17. A page description comprising image plot instructions 282 is used by the image plotting logic 290 in conjunction with the supply format data read to create print data. The image plotting logic 290 sends the print data to the line data shift logic 294 for conversion into a format suitable for the thermal print head 304. Logic 294 transfers the serial line dot data to the thermal print head 304 and to logic 296 which calculates the line dot density. Logic 296 transfers the calculated dot density information to logic 298 for calculation of the nominal value print data. Logic 298 also uses density information from the density control 308. Logic 298 outputs energized time and dwell time to scaling logic 292. Logic 292 also uses thermal scaling data read from bar code 284 by scanner 286 and interpreted by scanner logic 288. Logic 292 outputs the scaled on time and scaled dwell time to switch logic 300 and motor control logic 302, respectively. Logic 298 also uses temperature information from a temperature sensor and rank (performance characteristics) from the thermal print head 304. Logic 292 sends the scaled on time to switch logic 300 which controls pixel energization on the thermal print head 304. Logic 292 sends the scaled dwell time to the motor control logic 302 for the paper feed motor 306.

Figure 19A:
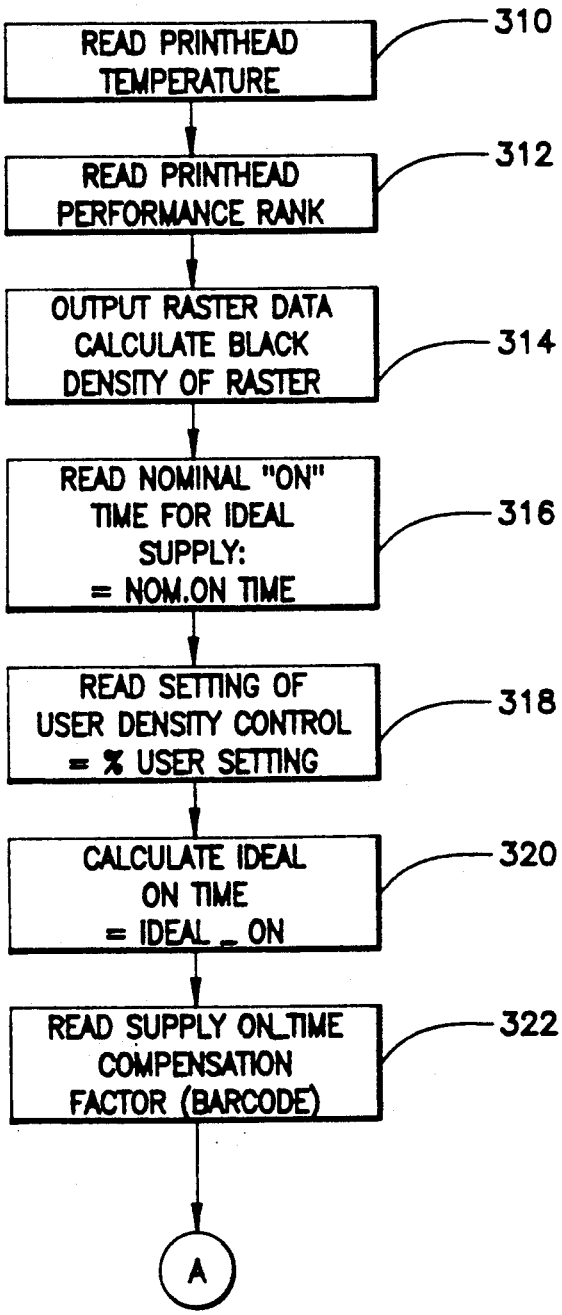
FIGS. 19*a* and 19*b* combined are a flowchart describing the print timing control method.
Figure 19B:
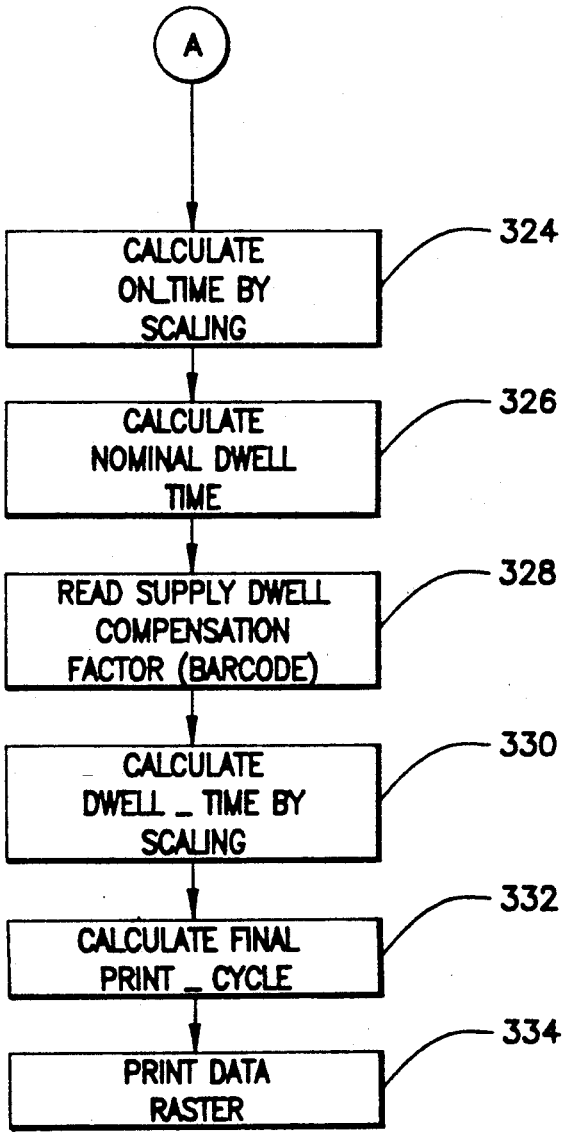
Figure 20A:
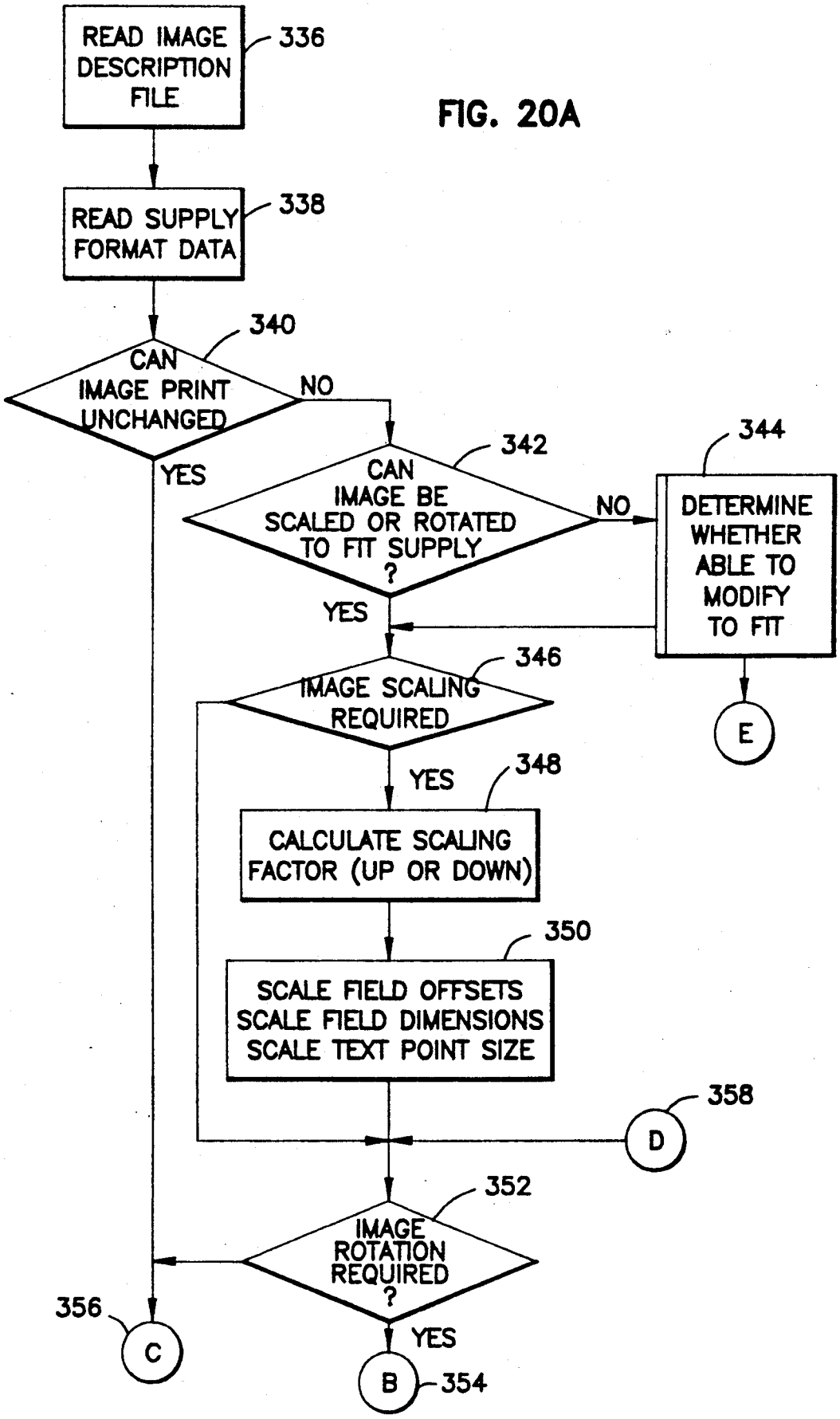
FIGS. 20*a*, 20*b*, and 20*c* combined are a flowchart describing the supply version image format processing method.
Figure 20B:
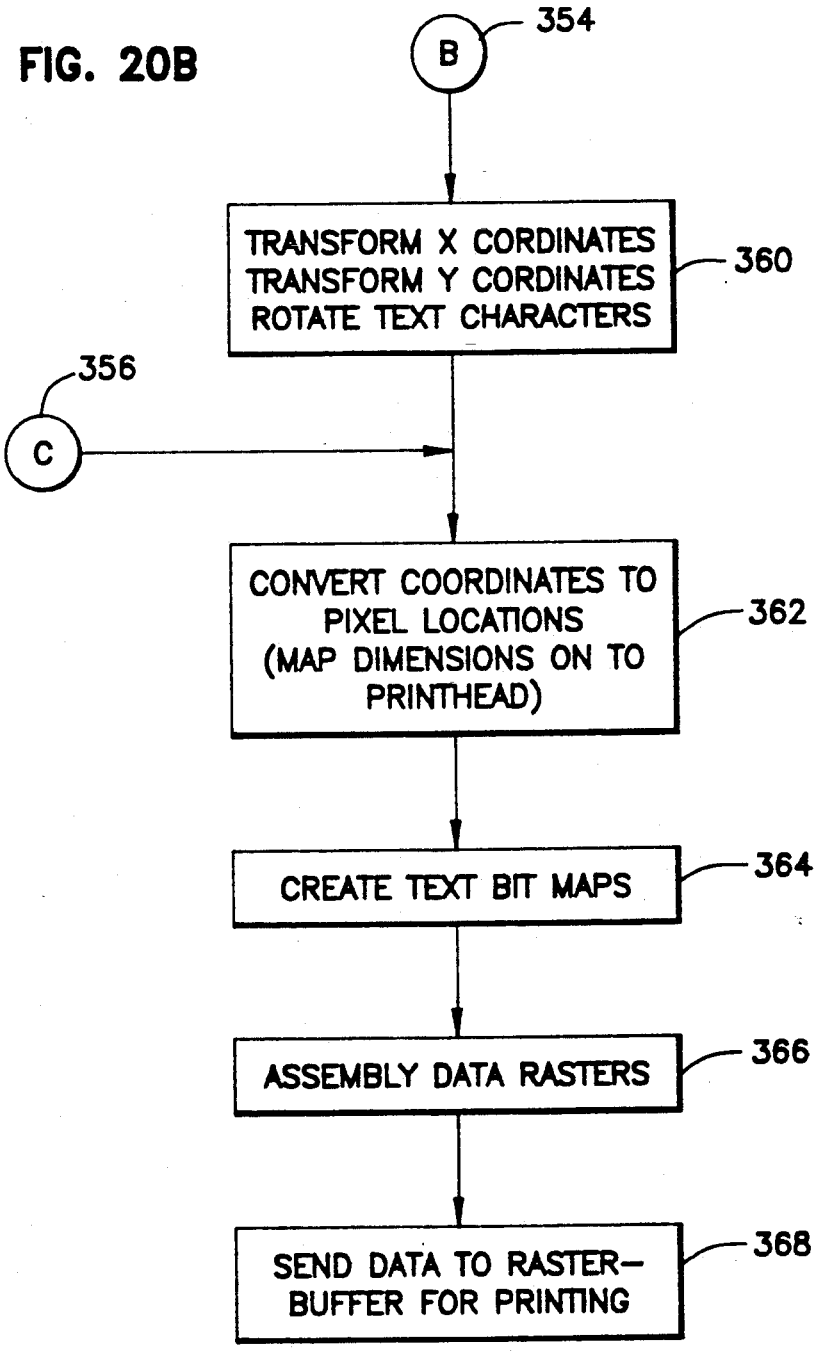
Figure 20C:
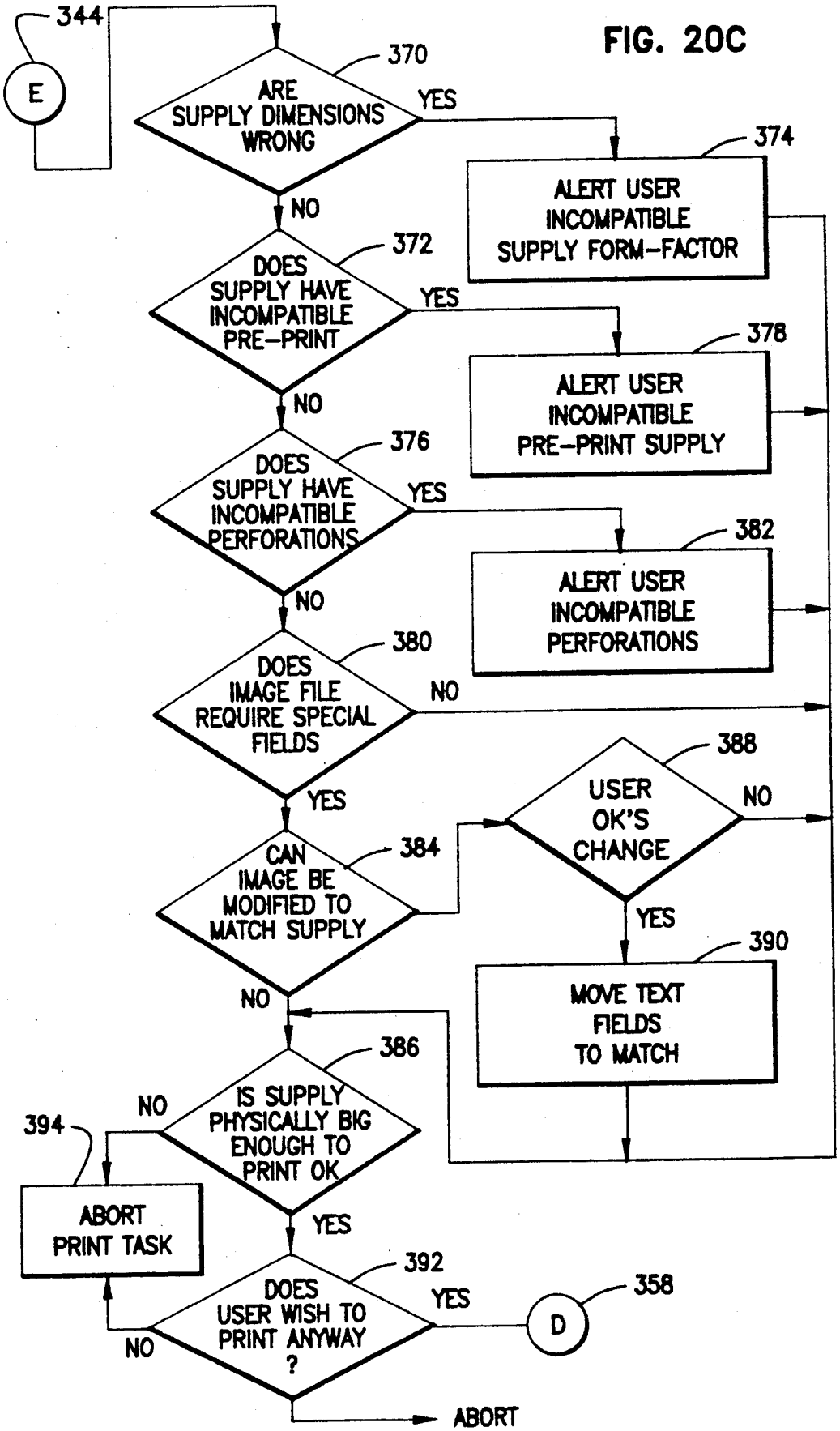

FIGS. 19*a* and 19*b* combined are a flowchart describing the print timing control method. Box 310 represents reading the temperature from the temperature sensor or thermistor on the print head 304. Box 312 represents reading the rank (performance characteristics) from a dip switch on the print head 304. Box 314 represents outputting raster data and calculating black density of the raster data when logic 294 shifts the data to the print head 304 and logic 296 counts the number of black bits. Box 316 represents the functions performed by logic 298 wherein the nominal on time is determined by a table lookup using the temperature and rank data. Box 318 represents logic 308 wherein density control is read. Box 320 represents the calculation of ideal on time by logic 298, which is the value of the nominal on time multiplied by the density control. Box 322 represents the reading of the thermal scaling data from bar code 284 by scanner 286 and logic 288. Box 324 represents the calculation of the scaled on time in logic 292 by multiplying the ideal on time by the thermal scaling data read from the bar code 284. Box 326 represents the calculation of nominal dwell time in logic 298 by subtracting the on time from the total cycle time. Box 328 represents the reading of the supply dwell compensation factor from the bar code 284. Box 330 represents the calculation of the dwell time in logic 292 by multiplying the nominal dwell time by the supply dwell compensation factor read from the bar code 284. Box 332 represents the calculation of the final print cycle in logic 292 by adding the on time to the dwell time. Box 334 represents the printing of the data by switch logic 300 controlling the operation of the thermal print head 304 and motor control logic 302 controlling the paper feed motor 306. FIGS. 20*a*, 20*b*, and 20*c* combined are a flowchart describing the supply version image format processing method. Box 336 represents the reading of the image description file 282 containing page layout data for a standard print sheet set, including any special user-defined printing requirements. Box 338 represents the reading of supply format data from the bar code 284 by the scanner 286 and logic 288. Box 340 represents a conditional branch within logic 290 determined by whether the image can be printed unchanged. If not, control transfers to box 342. Box 342 represents a conditional branch within logic 290 determined by whether the image can be scaled or rotated to fit the particular supply. If not, control is transferred to box 344, wherein logic 290 determines whether it is able to modify the image to fit the particular supply. If the image can be scaled or rotated to fit the particular supply, control is transferred to box 346. Box 346 represents a conditional branch in logic 290 determined by whether scaling of the image is required. If scaling is required, control is transferred to box 348. Box 348 represents the calculation of a scaling factor by logic 290. Box 350 represents the actual scaling of field offsets, field dimensions and text point sizes by logic 290. After scaling, or alternatively if scaling is not required, control is transferred to conditional branch 352. Box 352 represents a conditional branch within logic 290 determined by whether the image requires rotation. If rotation is required, control is transferred to box 354. If rotation is not required, control is transferred to box 356. Rotation occurs at box 360, wherein the x and y coordinates are transformed and text characters are rotated. Box 362 represents a conversion of coordinates to pixel locations, i.e., the mapping of dimensions onto the print head 304. Box 364 represents the creation of bit maps from the image plot instructions 282. Box 366 represents the assembly of data rasters into an image for printing. Box 368 represents the transfer of data to raster buffers for printing.

FIG. 20*c* further defines the processing of box 344 in FIG. 20*a*. Box 370 represents a conditional branch determined by incorrect supply dimensions. If the dimensions are incorrect, control transfers to box 374. Box 374 represents a message alerting the user of the incompatible supply forms. If the dimensions are correct, control transfers to box 372. Box 372 is a conditional branch determined by whether the supply forms have incompatible preprinted areas. If there are incompatible preprinted areas, control transfers to box 378. Box 378 represents a message alerting the user to the incompatible preprinted supply forms. If the supply form does not have incompatible preprinted areas, control is transferred to box 376. Box 376 represents a conditional branch determined by whether the supply forms have incompatible scoring or perforations. If there are incompatible perforations, control transfers to box 382. Box 382 represents a message alerting the user to the incompatible perforations. If there are no incompatible perforations, control transfers to box 380. Box 380 represents a conditional branch determined by whether the image requires special fields. If the image does require special fields, control is transferred to box 384. Box 384 represents a conditional branch determined by whether the image can be modified to match the supply forms. If not, control is transferred to box 388. Box 388 represents a conditional branch determined by whether the user permits the modification. If the user permits the modification, control transfers to box 390. Box 390 moves the text fields to match the supply form. If the user does not permit the modification, or if the image cannot be modified to match the supply forms, control is transferred to box 386. Control also transfers to box 386 after the text fields have been moved by box 390. Box 386 represents a conditional branch determined by whether the supply forms are physically big enough to hold the image. If the supply forms are not big enough, control is transferred to box 394 which aborts the printing process. If the supply forms are big enough, control transfers to box 392. Box 392 is a conditional branch determined by whether the user wishes to print the image regardless, after being alerted to the possible abort or that the supply forms are physically big enough to print. Control then transfers back to box 358 in FIG. 20*a*.

The graphics transformation methods required for rotating and translating images are well known in the art. For example, Roger T. Stevens, "Graphics Programming In C", 1988, which publication is incorporated herein by reference, provides a comprehensive resource for C programmers covering CGA, EGA, and VGA graphics displays and includes a complete tool box of graphic routines and sample programs. Another reference is Donald Hearn, "Computer Graphics", 1985, which publication is also incorporated herein by reference.

Scaleable digital type is also commonplace today. Commercial sources for type fonts and software for scaling include: Bitstream, Inc., Athenaum House, 215 First Street, Cambridge, MA, 02142; URW, Harksheider Str. 102, 2000 Hamburg 65, West Germany; and Font Technologies, 90 Industrial Way, Wilmington, MA, 01887.

Figure 21:
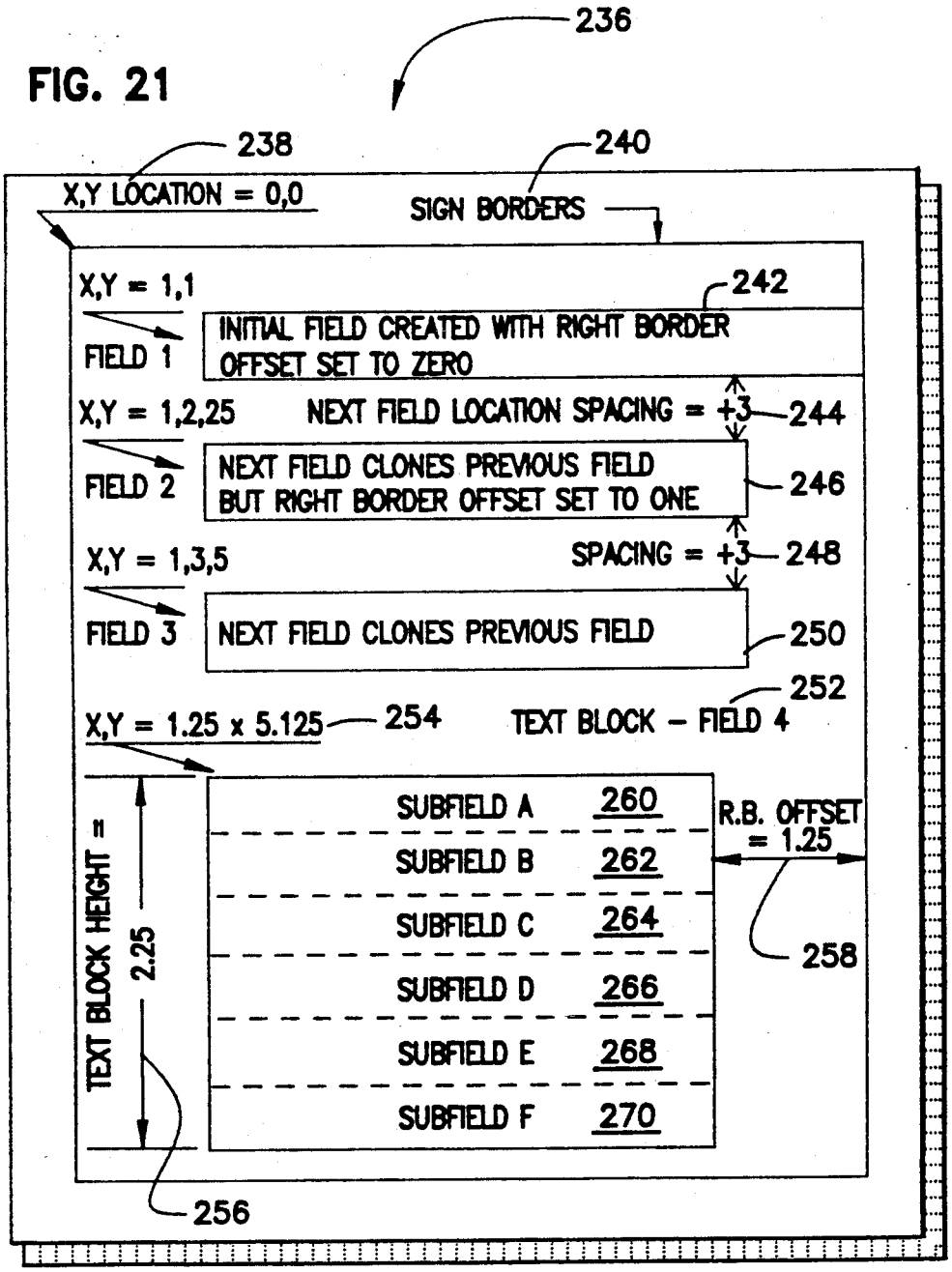
FIG. 21 is an example of an image description.

FIG. 21 is an example of an image description 236. The image 236 is oriented by means of an (x,y) location 238. The image 236 is further defined by borders 240. In the example, four fields 242, 246, 250 and 252 are defined. The first field 242 is determined relative to the (x,y) location 238 and created with a right border offset of 0. The second field 246 is a "clone" of the prior field with location spacing of three units. The right border of field 246 is offset to 1. The third field 250 again "clones" the previous field with an (x,y) location offset by three units 248. The fourth field 252 is a text block comprised six subfields 260–270. Field 252 has a specific (x,y) location 254, a height 256, and a right border offset 258.

Figure 22:
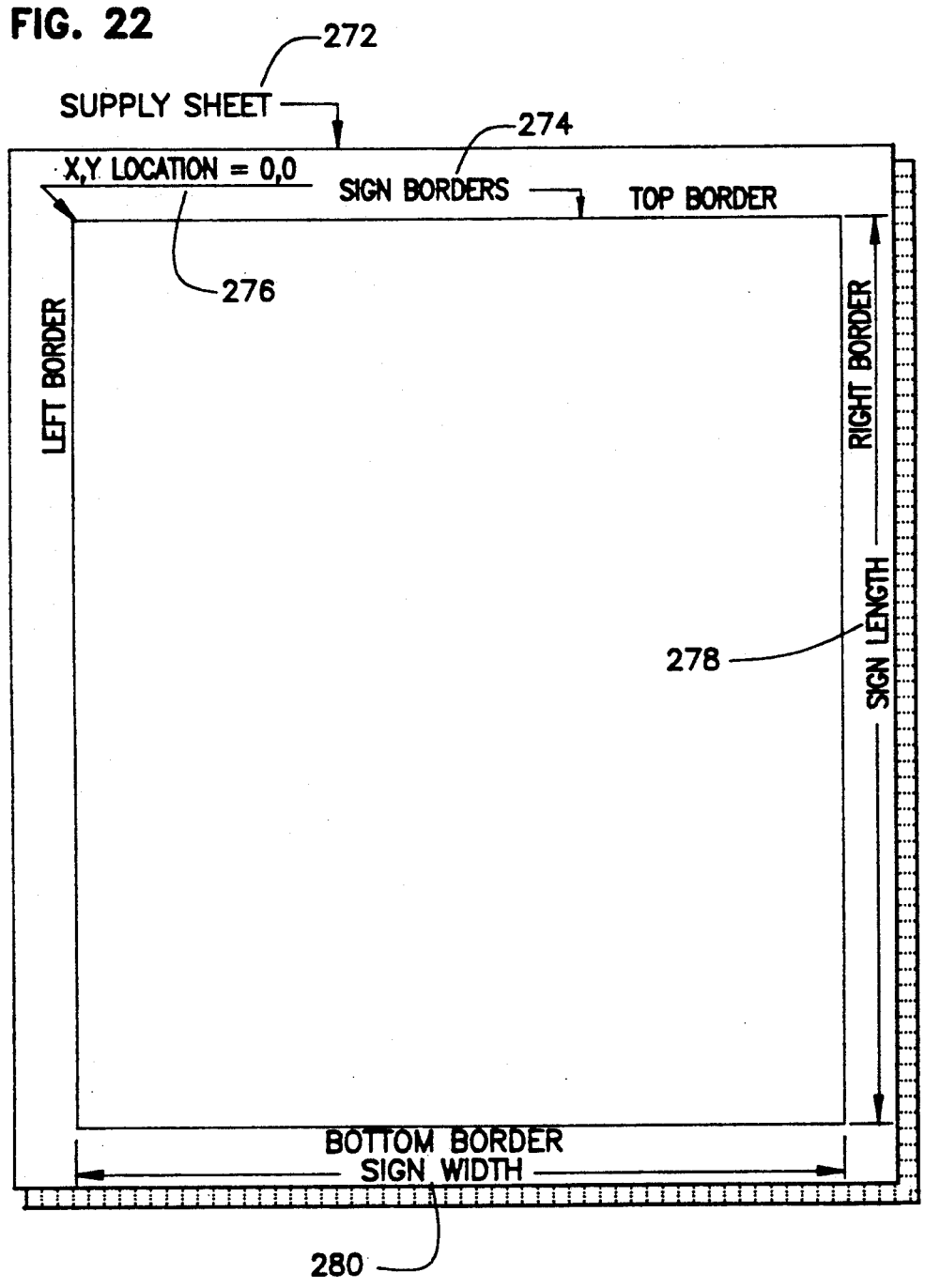
FIG. 22 is an example of a supply sheet.

FIG. 22 is an example of a supply sheet 272 having borders 274 located in terms of an (x,y) location 276, length 278, and width 280.

Figure 23:
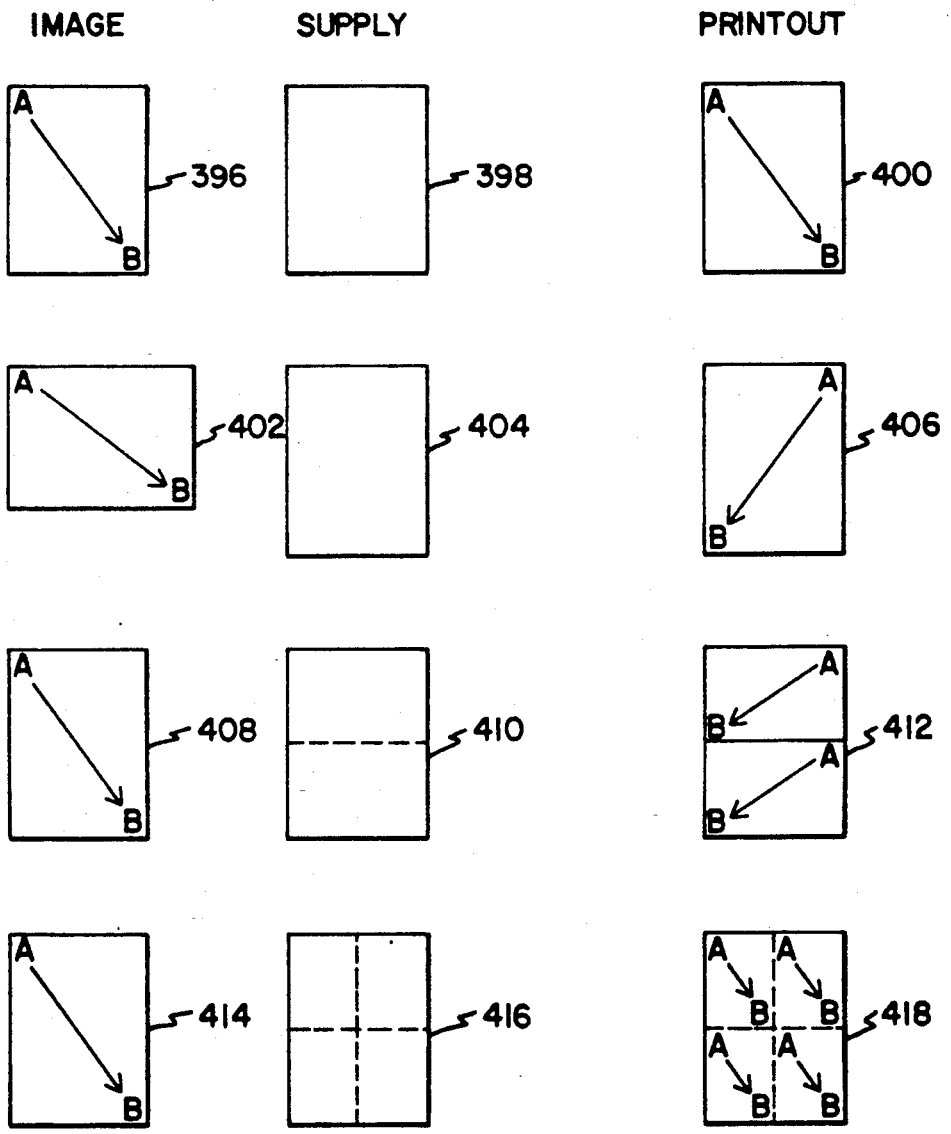
FIG. 23 describes some print processing cases where images are rotated and scaled.

FIG. 23 describes some print processing cases where images are rotated and scaled. In the first case, if the image is oriented as indicated in 396 and the supply is formatted according to 398, then there is no change in the output 400. If the image is oriented as indicated in 402 and the supply is formatted according to 404, then the image is rotated before printing in the output 406. If the image is oriented as indicated in 408 and the supply is formatted according to 410, then the image is rotated and scaled before printing in the output 412. If the image is oriented according to 414 and the supply is formatted according to 416, then the image is scaled in the output 418.

Figure 24:
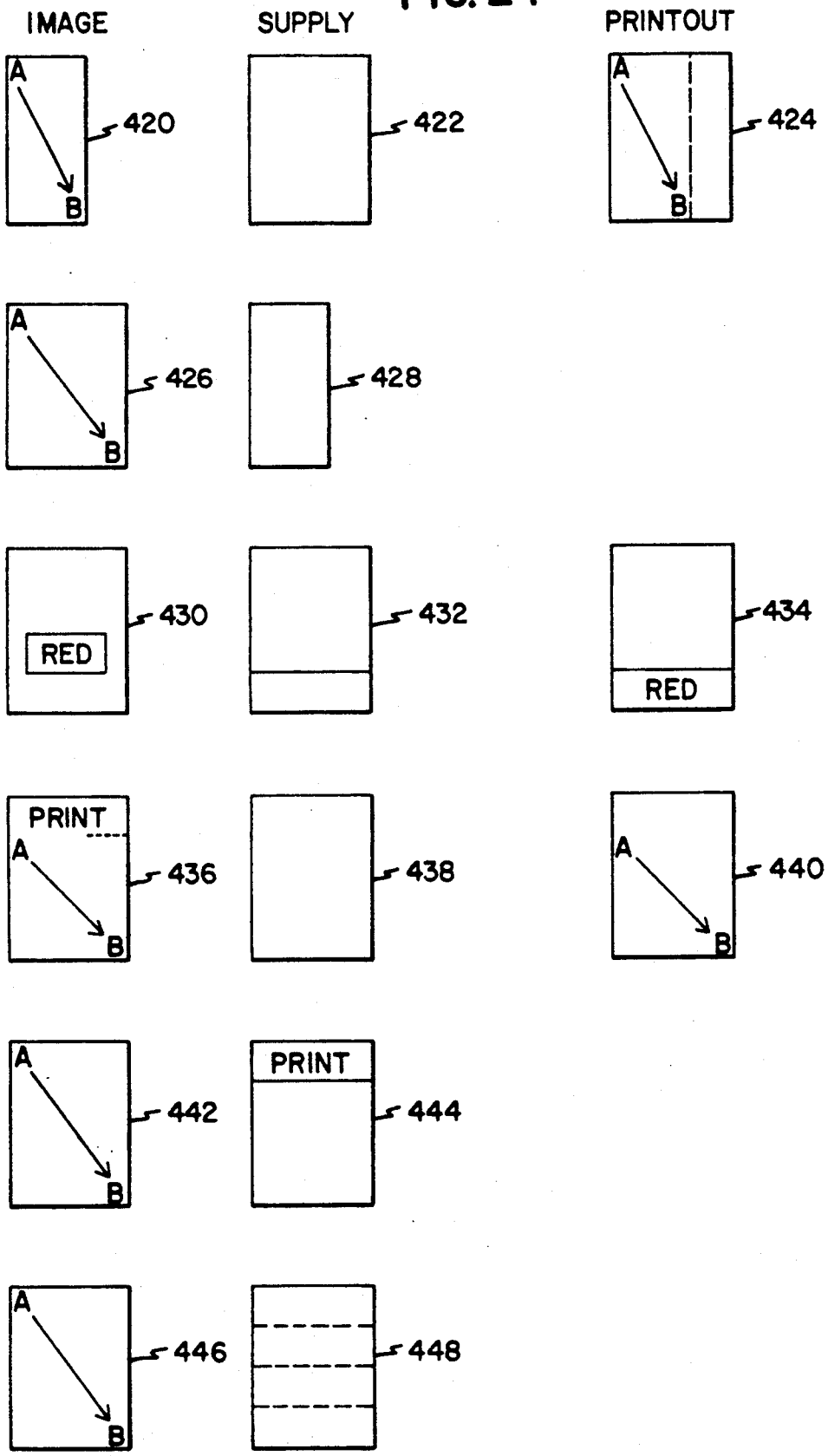
FIG. 24 describes some print processing cases wherein exception handling occurs due to incompatibilities between the images and the supply forms.

FIG. 24 describes some print processing cases wherein exception handling occurs due to incompatibilities between the images and the supply forms. If the image is oriented as indicated in 420 and the supply is formatted according to 422, then the image is printed in the output 424. If the image is oriented as indicated in 426 and the supply is formatted according to 428, then the image is not outputted because the supply has incompatible dimensions. If the image has a color field as indicated by 430 and the supply is formatted according to 432, then the field is moved to the corresponding placement on the supply in the output 434. If the image is placed adjacent a preprinted area as indicated by 436 and the supply is formatted according to 438, then the image is printed even if the output 440 is missing the preprinted area. If the image is scaled as indicated in 442 and the supply is formatted according to 444, then the image is not output because the image would overlap the preprinted area. If the image is scaled as indicated in 446 and the supply is formatted according to 448, then the image is not output as the supply has incompatible perforations.

Figure 25:
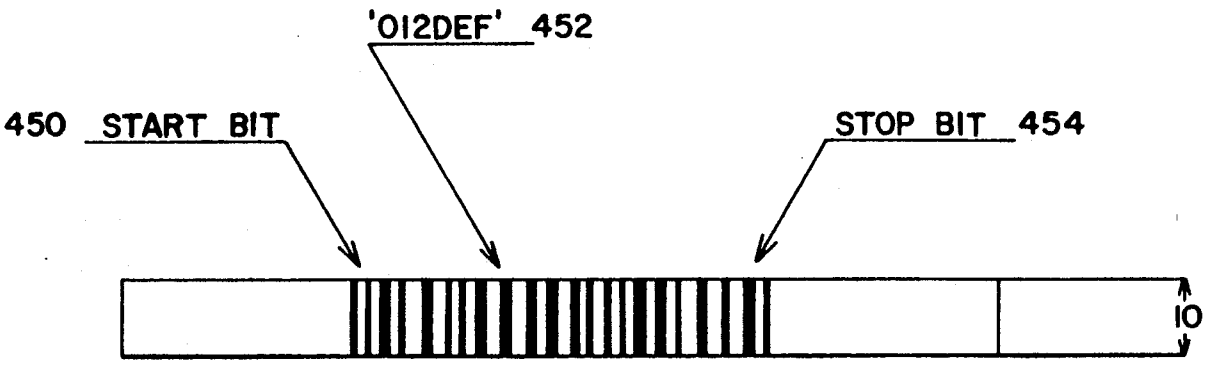
FIG. 25 describes the bar code used in the preferred embodiment.

FIG. 25 illustrates the bar code used in the preferred embodiment. The bar code consists of a 24 bit interleaved data pattern. The first 2 black stripes or "bars" and the first 2 white stripes or "spaces" represent a start bit indicator 450. The last 2 black stripes or "bars" and the last 2 white stripes or "spaces" represent a stop bit indicator 452. The remaining 18 bars and 18 spaces therebetween represent a 6 character hexadecimal string 452, which in turn represents a 24-bit binary value. The bars represent 12-bit thermal scaling data and the spaces represent 12-bit format supply data.

Note that every 6 bars or spaces encode a single hexadecimal character. The characters are read from left to right, bars then spaces, and appended in order. Thus, the hexadecimal string 452 of FIG. 25 is "012DEF". The coding of the hexadecimal characters is described below, wherein the hexadecimal character is equal to the summation of the weighted values minus 5. Further, in the pattern, a "1" represents a wide bar or space, and a "0" represents a narrow bar or space.

| Hexadecimal Character | Weighted Value 1 | 2 | 4 | 7 | 13 | Parity | Sum of Weighted Values |
|---|---|---|---|---|---|---|---|
| 0 | 1 | 0 | 1 | 0 | 0 | 1 | 5 |
| 1 | 0 | 1 | 1 | 0 | 0 | 1 | 6 |
| 2 | 1 | 1 | 1 | 0 | 0 | 0 | 7 |
| 3 | 1 | 0 | 0 | 1 | 0 | 1 | 8 |
| 4 | 0 | 1 | 0 | 1 | 0 | 1 | 9 |
| 5 | 1 | 1 | 0 | 1 | 0 | 0 | 10 |
| 6 | 0 | 0 | 1 | 1 | 0 | 1 | 11 |
| 7 | 1 | 0 | 1 | 1 | 0 | 0 | 12 |
| 8 | 0 | 1 | 1 | 1 | 0 | 0 | 13 |
| 9 | 1 | 0 | 0 | 0 | 1 | 1 | 14 |
| A | 0 | 1 | 0 | 0 | 1 | 1 | 15 |
| B | 1 | 1 | 0 | 0 | 1 | 0 | 16 |

-continued

| Hexadecimal Character | Weighted Value 1 | 2 | 4 | 7 | 13 | Parity | Sum of Weighted Values |
|---|---|---|---|---|---|---|---|
| C | 0 | 0 | 1 | 0 | 1 | 1 | 17 |
| D | 1 | 0 | 1 | 0 | 1 | 0 | 18 |
| E | 0 | 1 | 1 | 0 | 1 | 0 | 19 |
| F | 0 | 0 | 0 | 1 | 1 | 1 | 20 |

The thermal scaling data is comprised of two parts: a 4-bit cycle time scaling factor and an 8-bit on time scaling factor. Each can be adjusted by ±/−100%. The on time scaling factor can be adjusted by less than 1% increments; the cycle time scaling factor can be adjusted by approximately 12% increments.

The on time scaling factor is represented by a weighted summation of the bits:

| | Binary Pattern | | Value |
|---|---|---|---|
| f0 | 0 | 0000000 | 0.00000000 |
| f1 | 0 | 0000001 | 0.00781250 |
| f2 | 0 | 0000010 | 0.01562500 |
| f3 | 0 | 0000100 | 0.03125000 |
| f4 | 0 | 0001000 | 0.06250000 |
| f5 | 0 | 0010000 | 0.12500000 |
| f6 | 0 | 0100000 | 0.25000000 |
| f7 | 0 | 1000000 | 0.50000000 |
| f8 | 1 | 0000000 | 1.00000000 |

For example, the on time scaling factor represented by the binary pattern "1 1001001" would be the summation of f8+f7+f4+f1, or, the value 1+0.5+0.0625+0.0078125=1.5703125.

The cycle time scaling factor is also represented by a weighted summation of the bits:

| | Binary Pattern | | Value |
|---|---|---|---|
| f0 | 0 | 000 | 0.000 |
| f1 | 0 | 001 | 0.125 |
| f2 | 0 | 010 | 0.250 |
| f3 | 0 | 100 | 0.500 |
| f4 | 1 | 000 | 1.000 |

For example, the cycle time scaling factor represented by the binary pattern "1 101" would be the summation of f4+f3+f1, or, the value 1+0.5+0.125=1.625.

The supply format data is comprised of multiple parts: a 1-bit extended code bit (where 0=normal code; 1=match code), followed by an 11-bit field. If the extended code bit is set to 0, i.e., normal code, then the 11-bit field is comprised a 2-bit width code (specifying 1 of 4 widths); a 1-bit half sheet code (where 1=true); a 2-bit format select (specifying 1 of 4 formats); and a 6-bit extended format (representing 64 combinations). If the extended code bit is set to 1, i.e., match code, then a search is made for a match between the 11-bit field and one of 2048 bit pattern combinations identifying a format from a table of pre-defined formats.

Thus, the system relieves the operator of extensive experimentation and waste of time and supplies in arriving at an appropriate size of type, etc., for a desired message and size of print field. From the foregoing, it will be noted that the present invention provides a thermal printing system which can automatically format and print signs, the system embodying a print sheet set, including a print sheet having means thereon for effecting the programming of a thermal printer to print within certain areas of the print sheet and for otherwise effecting control of the printer to print according to such conditions as the material of the print sheet, the optimum thermal energy necessary to effect a desired printing quality and the particular format to be used. Such automatic control safeguards the printer from damage which might result from inappropriate setting or adjustments by the operator. Also, the use of the aforementioned print sheet sets eliminates the necessity of providing the usual printing ribbon and ribbon feeding mechanism.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A print sheet set for a thermal printer, comprising:

a print sheet, a heat sensitive image transfer sheet overlying said print sheet, and identifiers on said print sheet for controlling a thermal printer by indicating an optimal amount of thermal energy for printing on said print sheet using said image transfer sheet, a size of at least one print field within said print sheet, and an appropriate size of data to be printed commensurate with said size of said print field.

2. A print sheet set according to claim 1, wherein said identifiers indicate said print sheet is comprised of a particular type of material.

3. A print sheet set according to claim 1, wherein said identifiers indicate scaling of said data is required for printing said data in said print field.

4. A print sheet set according to claim 1, wherein said identifiers indicate said print sheet is unsuitable for printing said data.

5. A print sheet set according to claim 1, wherein said identifiers indicate said print sheet is comprised of zones of different colors and wherein said identifiers identify said zones.

6. A print sheet set according to claim 1, wherein said identifiers comprise coded indicia.

7. A print sheet set according to claim 1, further comprising means for dividing said print sheet into a code zone and a print zone, and means for permanently securing a part of said transfer sheet to said code zone.

8. A print sheet set according to claim 7, wherein said means for dividing comprises a weakened tear line formed in said print sheet facilitating separation of said zones.

9. A print sheet set according to claim 1, further comprising means for dividing said print sheet into said print fields, said means for dividing comprising a weakened tear line formed in said print sheet facilitating separation of said print sheet into said print fields.

10. A print sheet set according to claim 1, wherein said identifiers indicate a duplication of said data is required for printing said data in a plurality of said print fields.

11. A thermal printer, comprising:

means for sensing identifiers on a print sheet indicating an optimal amount of thermal energy for printing, a size of at least one print field within said print sheet, and an appropriate size of data to be printed commensurate with said size of said print field, and means, coupled to said sensing means, for programming said thermal printer to print said data in accordance with said identifiers.

12. The thermal printer of claim 11, wherein said identifiers indicate said print sheet is comprised of a particular type of material.

13. The thermal printer of claim 11, wherein said identifiers indicate scaling of said data is required for printing said data in said print field.

14. The thermal printer of claim 11, wherein said identifiers indicate said print sheet is unsuitable for printing said data.

15. The thermal printer of claim 11, wherein said print sheet is comprised of zones of different colors and wherein said identifiers identify said zones.

16. The thermal printer of claim 11, wherein said identifiers comprise coded indicia.

17. The thermal printer of claim 11, wherein said identifiers indicate a duplication of said data is required for printing said data in a plurality of said print fields.

18. A print sheet apparatus for a thermal printer, comprising:

print sheet means, responsive to thermal energy, for producing images thereon, and machine readable identifiers coupled to said print sheet means for controlling a thermal printer by indicating an optimal amount of thermal energy for printing on said print sheet means, a size of at least one print field within said print sheet means, and an appropriate size of data to be printed commensurate with said size of said print field.

19. A print sheet apparatus according to claim 18, wherein said print sheet means is comprised of zones of different colors and wherein said identifiers identify said zones.

20. A print sheet apparatus according to claim 18, wherein said identifiers indicate said print sheet means is comprised of a particular type of material.

21. A print sheet apparatus according to claim 18, wherein said identifiers indicate scaling of said data is required for printing said data in said print field.

22. A print sheet apparatus according to claim 18, wherein said identifiers indicate said print sheet means is unsuitable for printing said data.

23. A print sheet apparatus according to claim 18, wherein said print sheet means comprises a direct thermal transfer sheet.

24. A print sheet apparatus according to claim 18, wherein said identifiers comprise coded indicia.

25. A print sheet apparatus as defined in claim 18, wherein said print sheet means comprises a code zone and a print zone, a weakened tear line intermediate said zones, and means for permanently attaching a heat sensitive image transfer sheet to said print sheet means in said code zone.

26. A print sheet apparatus as defined in claim 18, wherein said identifiers indicate a duplication of said data is required for printing said data in a plurality of said print fields.

* * * * *

UNITED STATES PATENT AND TRADEMARK OFFICE

CERTIFICATE OF CORRECTION

PATENT NO. : 5,085,529

DATED : February 4, 1992

INVENTOR(S) : T. K. McGourty et al.

It is certified that error appears in the above-identified patent and that said Letters Patent is hereby corrected as shown below:

Column 2, line 6, "code" should read --coded--.

Column 5, line 3, insert --a-- after the word "by".

Column 8, line 23, "specifics" should read --specifies--.

Column 8, line 29, "±/-" should read --+/- --.

Column 13, line 61, insert --of-- after the word "comprised".

Column 15, line 12, "±/-" shoud read -- +/- --

Column 15, line 52, insert --of-- after the word "comprised".

Claim 1, column 16, line 29, delete "," after the word "sheet" insert --and a format for said print sheet, wherein said format specifies-- after the word "sheet".

Claim 1, column 16, line 30, delete "," after the word "sheet".

Claim 11, column 16, line 68 and column 17, line 1, delete "," after the word "printing".

UNITED STATES PATENT AND TRADEMARK OFFICE

CERTIFICATE OF CORRECTION

PATENT NO. : 5,085,529

DATED : February 4, 1992

INVENTOR(S) : T. K. McGourty et al.

It is certified that error appears in the above-identified patent and that said Letters Patent is hereby corrected as shown below:

Claim 11, column 17, line 1, insert --and a format for said print sheet, wherein said format specifies-- after the word printing.

Claim 11, column 17, line 6, insert --optimal amount of thermal energy and said format indicated by said -- after the word "said".

Claim 18, column 17, line 31, delete "," after the word "means".

Claim 18, column 17, line 31, insert -- and a format for said print sheet means, wherein said format specifies-- after the word "means".

Signed and Sealed this

Ninth Day of November, 1993

*Attest:*

*Attesting Officer*

BRUCE LEHMAN

*Commissioner of Patents and Trademarks*